US010986898B2

(12) United States Patent
Boardman et al.

(10) Patent No.: US 10,986,898 B2
(45) Date of Patent: Apr. 27, 2021

(54) INDUCTION HEATING APPARATUSES AND PROCESSES FOR FOOTWEAR MANUFACTURING

(71) Applicant: NIKE, Inc., Beaverton, OR (US)

(72) Inventors: Eric A. Boardman, Portland, OR (US); Levi J. Patton, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 132 days.

(21) Appl. No.: 15/994,327

(22) Filed: May 31, 2018

(65) Prior Publication Data

US 2018/0271221 A1 Sep. 27, 2018

Related U.S. Application Data

(63) Continuation of application No. 13/539,295, filed on Jun. 29, 2012, now Pat. No. 9,986,787.

(51) Int. Cl.

| | |
|---|---|
| ***A43D 3/02*** | (2006.01) |
| ***A43B 13/28*** | (2006.01) |
| ***A43B 23/02*** | (2006.01) |
| ***A43B 23/08*** | (2006.01) |
| ***A43B 23/17*** | (2006.01) |

(Continued)

(52) U.S. Cl.

CPC ..... *A43D 3/02* (2013.01); *A43B 13/28* (2013.01); *A43B 23/0255* (2013.01); *A43B 23/087* (2013.01); *A43B 23/17* (2013.01); *A43D 3/026* (2013.01); *A43D 11/12* (2013.01); *H05B 6/105* (2013.01); *H05B 6/106* (2013.01)

(58) Field of Classification Search

CPC . A43D 3/00; A43D 3/02; A43D 3/026; A43D 23/022; A43D 23/025; H05B 6/105; H05B 6/106

USPC ..... 12/133 R, 133 M, 145

See application file for complete search history.

(56) References Cited

U.S. PATENT DOCUMENTS 208,513 A * 10/1878 Chenette ..... A43D 3/026 12/137
1,121,236 A * 12/1914 Dunbar ..... A43D 3/02 12/133 R (Continued)

FOREIGN PATENT DOCUMENTS

CN 1121403 A 5/1996
DE 3405964 A1 1/1985

(Continued)

OTHER PUBLICATIONS

National Office of Intellectual Property (Vietnam), Office Action for VN Application No. 1-2015-00320, dated May 7, 2018.

(Continued)

*Primary Examiner* — Sharon M Prange

(74) *Attorney, Agent, or Firm* — Honigman LLP; Matthew H. Szalach; Jonathan P. O'Brien

(57) ABSTRACT

An apparatus for making an article of footwear is provided. The apparatus may include a last shaped to resemble a human foot and being formed at least in part from a susceptor material that is thermally reactive to an electromagnetic field. The apparatus may also include an induction coil disposed proximate to the last and configured to produce an electromagnetic field that causes the susceptor material in the last to increase in temperature by induction heating.

19 Claims, 31 Drawing Sheets

(51) Int. Cl.
*A43D 11/12* (2006.01)
*H05B 6/10* (2006.01)

(56) References Cited

U.S. PATENT DOCUMENTS

| | | | | |
|---|---|---|---|---|
| 1,390,998 | A * | 9/1921 | Lund | A43D 95/10 219/635 |
| 2,569,764 | A | 10/1951 | Jonas | |
| 2,893,059 | A * | 7/1959 | Mediano Capdevila | A43D 3/026 12/135 R |
| 2,893,095 | A | 7/1959 | Mediano Capdevila | |
| 3,641,688 | A | 2/1972 | von den Benken | |
| 3,676,542 | A * | 7/1972 | Maltby | A43B 13/28 264/244 |
| 3,821,827 | A | 7/1974 | Nadler | |
| 3,896,516 | A | 7/1975 | Von Den Benken | |
| 3,938,266 | A | 2/1976 | Cook | |
| 3,983,204 | A | 9/1976 | Opinsky et al. | |
| 4,038,762 | A | 8/1977 | Swan, Jr. | |
| 4,108,928 | A | 8/1978 | Swan, Jr. | |
| 4,272,898 | A | 6/1981 | Tansill | |
| 4,508,582 | A | 4/1985 | Fink | |
| 4,562,607 | A | 1/1986 | Trask | |
| 4,617,921 | A | 10/1986 | Seeler | |
| 5,203,793 | A | 4/1993 | Lyden | |
| 5,218,975 | A | 6/1993 | Prostkoff | |
| 5,272,216 | A | 12/1993 | Clark, Jr. et al. | |
| 5,499,460 | A | 3/1996 | Bryant et al. | |
| 5,714,098 | A | 2/1998 | Potter | |
| 5,733,647 | A | 3/1998 | Moore, III et al. | |
| 5,766,704 | A | 6/1998 | Allen et al. | |
| 5,800,896 | A | 9/1998 | Kobayashi | |
| 5,837,088 | A | 11/1998 | Palmgren et al. | |
| 5,939,157 | A | 8/1999 | Allen et al. | |
| 6,003,248 | A | 12/1999 | Hilgarth | |
| 6,004,662 | A | 12/1999 | Buckley | |
| 6,346,210 | B1 | 2/2002 | Swartz et al. | |
| 6,746,767 | B2 | 6/2004 | Gottfried et al. | |
| 6,761,747 | B2 | 7/2004 | Gottfried et al. | |
| 6,763,609 | B2 | 7/2004 | Su | |
| 6,805,825 | B1 * | 10/2004 | MacLeod | A43D 3/026 264/244 |
| 6,812,271 | B2 | 11/2004 | Swartz et al. | |
| 6,939,477 | B2 | 9/2005 | Stark et al. | |
| 7,013,587 | B2 | 3/2006 | Yama | |
| 7,111,414 | B2 | 9/2006 | Willis et al. | |
| 7,219,446 | B1 | 5/2007 | Haimerl | |
| 7,569,624 | B2 | 8/2009 | Kolbe et al. | |
| 7,669,352 | B2 | 3/2010 | Stefani | |
| 7,785,673 | B2 | 8/2010 | Lasko | |
| 7,810,257 | B2 | 10/2010 | Candrian et al. | |
| 7,823,299 | B1 | 11/2010 | Brigham | |
| 7,837,892 | B2 | 11/2010 | Pridoehl et al. | |
| 2007/0033750 | A1 | 2/2007 | Cook et al. | |
| 2007/0267398 | A1 | 11/2007 | McCoy et al. | |
| 2008/0164247 | A1 | 7/2008 | Chen et al. | |
| 2009/0159834 | A1 | 6/2009 | Roos et al. | |
| 2009/0165949 | A1 | 7/2009 | Roos et al. | |
| 2011/0220634 | A1 | 9/2011 | Yeh | |
| 2014/0000044 | A1 | 1/2014 | Boardman et al. | |

FOREIGN PATENT DOCUMENTS

| | | | |
|---|---|---|---|
| DE | 3437786 | A1 | 4/1986 |
| EP | 0154170 | A1 | 9/1985 |
| EP | 0919151 | A1 | 6/1999 |
| FR | 1197628 | A | 12/1959 |
| FR | 2057670 | A5 | 5/1971 |
| GB | 1275095 | A | 5/1972 |
| GB | 2109220 | A | 6/1983 |
| JP | H04206189 | A | 7/1992 |
| KR | 20010113120 | A | 12/2001 |
| TW | 411264 | B | 11/2000 |
| WO | WO-8503624 | A1 | 8/1985 |
| WO | WO-2008148588 | A1 | 12/2008 |
| WO | WO-2009132911 | A2 | 11/2009 |
| WO | WO-2009132912 | A2 | 11/2009 |
| WO | WO-2010063557 | A1 | 6/2010 |
| WO | WO-2010149443 | A1 | 12/2010 |
| WO | WO-2010149463 | A1 | 12/2010 |
| WO | WO-2011023430 | A1 | 3/2011 |
| WO | WO-2014004756 | A1 | 1/2014 |
| WO | WO-2014004759 | A1 | 1/2014 |

OTHER PUBLICATIONS

European Patent Office, International Preliminary Report on Patentability for International Application No. PCT/US2013/048046, dated Dec. 31, 2014.
State Intellectual Property Office, Chinese Office Action for CN Application No. 201380045001.1, dated Oct. 10, 2015.
Korean Patent Office, Korean Office Action for KR Application No. 10-2015-7002362, dated Jun. 21, 2016.
International Searching Authority, International Search Report and Written Opinion for Application No. PCT/US2013/048051, dated Nov. 22, 2013.
Office Action dated Jul. 9, 2014 in U.S. Appl. No. 13/539,298.
Response filed Sep. 30, 2014 in U.S. Appl. No. 13/539,298.
International Search Report and Written Opinion dated Oct. 11, 2013, in PCT Application No. PCT/US2013/048046.
Garcia, Schlangen, Van De Ven, Van Viliet, Induction Heating of Mastic Containing Conductive Fibers and Fillers, Materials and Structures, published at Springerlink.com, Jul. 30, 2010.
Fink, Yarlagadda, Xiao, Laverty, Gillespie,Jr., Functional Nanostructures for Induction Heating: A Review of Literature and Recommendations for Research, Army Research Laboratory, ARL-TR-2365, Nov. 2000.
United States Patent and Trademark Office, Non-final Office Action for U.S. Appl. No. 13/539,295, dated Jun. 22, 2015.
United States Patent and Trademark Office, Final Office Action for U.S. Appl. No. 13/539,295, dated Jan. 5, 2016.
United States Patent and Trademark Office, Non-final Office Action for U.S. Appl. No. 13/539,295, dated Feb. 13, 2017.
United States Patent and Trademark Office, Final Office Action for U.S. Appl. No. 13/539,295, dated Sep. 19, 2017.

* cited by examiner

INDUCTION HEATING APPARATUSES AND PROCESSES FOR FOOTWEAR MANUFACTURING

CROSS-REFERENCE TO RELATED APPLICATIONS

This application is a continuation of U.S. patent application Ser. No. 13/539,295, filed Jun. 29, 2012, the disclosure of which is hereby incorporated by reference in its entirety.

BACKGROUND

Articles of athletic footwear often include two primary elements, an upper and a sole structure. The upper provides a comfortable covering for the foot and securely positions the foot with respect to the sole structure. The sole structure is secured to a lower portion of the upper (for example, through adhesive bonding) and is generally positioned between the foot and the ground. In addition to attenuating ground reaction forces (that is, providing cushioning) during walking, running, and other ambulatory activities, the sole structure may influence foot motions (for example, by resisting pronation), impart stability, and provide traction. Accordingly, the upper and the sole structure operate cooperatively to provide a comfortable structure that is suited for a wide variety of athletic activities.

The upper is often formed from a plurality of material elements (for example, textiles, polymer sheets, foam layers, leather, and/or synthetic leather) that are stitched and/or adhesively bonded together to form a void on the interior of the footwear for receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear. Further, the upper may incorporate a heel counter to provide stability, rigidity, and support to the heel and ankle portion of the foot.

The sole structure may include one or more components. For example, the sole structure may include a ground-contacting sole component. The ground-contacting sole component may be fashioned from a durable and wear-resistant material (such as rubber or plastic), and may include ground-engaging members, tread patterns, and/or texturing to provide traction.

In addition, in some embodiments, the sole structure may include a midsole and/or a sockliner. The midsole, if included, may be secured to a lower surface of the upper and forms a middle portion of the sole structure. Many midsole configurations are primarily formed from a resilient polymer foam material, such as polyurethane or ethylvinylacetate, that extends throughout the length and width of the footwear. The midsole may also incorporate fluid-filled chambers, plates, moderators, or other elements that further attenuate forces, influence the motions of the foot, or impart stability, for example. The sockliner is a thin, compressible member located within the upper and positioned to extend under a lower surface of the foot to enhance footwear comfort.

The footwear components discussed above may be assembled together using various methods, including, for example, stitching, adhesives, welding, and other joining techniques. Articles of footwear may be assembled, at least in part, on a structure called a "last." A last is a form having the general shape of a human foot. During manufacturing, an article of footwear may be assembled around a last, in order to create a shoe with the desired shape. For example, upper materials/panels may be assembled, or otherwise placed, on a last. Then other components, such as midsole components and/or ground-contacting components may be attached to the upper, while fitted on the last. A last is typically not shaped like any particular type of foot, but rather is formed having a shape wherein the dimensions are averages of many different foot types, in order to produce a shoe that fits a variety of foot types.

When joining footwear components using welds and/or adhesives, heat may be applied to select portions of the footwear components. Therefore, systems have been developed to provide heat to certain portions of footwear components. There are various ways in which the heat may be applied. The heat may activate adhesive applied to portions of the footwear components, thereby joining the components. In some cases, the heat may be applied to effectively melt portions of footwear components (for example plastics) in order to join the components together. In other techniques, heat may be applied to footwear components in order to shape the components. For example, such techniques may involve heating a footwear component while a form (such as a last or an actual human foot) is pressed against it, in order to mold the component to the form.

Systems have been developed that apply heat using electrical heating elements. Some systems incorporate electrical heating elements into the last. Once heated by the electrical heating elements, the last conductively transmits heat to components of footwear fitted on the last or otherwise pressed against it. Such systems heat adhesives applied to the footwear components in order to join the components to one another.

In other systems, irradiative heating may be applied to join components of footwear. For example, microwave or infrared irradiation may be applied to footwear components from external sources to apply heat for shaping or joining footwear components. Some systems have been developed that apply microwave or infrared irradiation to heat adhesives in order to join footwear components.

SUMMARY

In some articles of footwear, induction heating may be utilized to apply heat to components of the footwear. Induction heating generally involves the application of an electromagnetic field to an object formed of an electrically conducting material (for example a metal). This creates electromagnetic induction, wherein the electromagnetic field generates eddy currents in the electrically conducting material, and the resistance of the material leads to Joule heating of the material. Certain materials are thermally reactive to magnetic fields (by virtue of being electrically conductive). Such materials are called "susceptors" or "susceptor materials." When exposed to an electromagnetic field, a susceptor material increases in temperature.

In some footwear manufacturing processes, footwear components or adhesives used to join footwear components may include susceptor materials. When exposed to an electromagnetic field, select portions of footwear components and/or adhesives that are formed of susceptor materials are heated in order to shape or join the footwear components. For example, one method involves the implementation of a susceptor-impregnated insole, which is molded to a wearer's foot upon induction heating of the insole. Another method involves welding two panels of an upper together by melting a layer of the panel material. The layer includes a susceptor material, which heats when exposed to an electromagnetic field, causing the layer to melt.

In one aspect, the present disclosure is directed to an apparatus for making an article of footwear. The apparatus may include a last shaped to resemble a human foot and being formed at least in part from a susceptor material that is thermally reactive to an electromagnetic field. The apparatus may also include an induction coil disposed proximate to the last and configured to produce an electromagnetic field that causes the susceptor material in the last to increase in temperature by induction heating.

In another aspect, the present disclosure is directed to a method of making an article of footwear. The method may include providing a last shaped to resemble a human foot and formed at least in part from a susceptor material that is thermally reactive to an electromagnetic field. The method may also include covering the last at least in part with one or more footwear components of an article of footwear. Further, the method may include placing the susceptor material in proximity with the one or more footwear components covering the last and placing the last in proximity with an induction coil. Also, the method may include increasing the temperature of the susceptor material by induction heating by producing an electromagnetic field using the induction coil, and transferring heat from the susceptor material to the one or more footwear components covering the last.

In another aspect, the present disclosure is directed to a method of making an article of footwear. The method may include providing a last shaped to resemble a human foot. The method may also include forming at least one footwear component at least in part from a susceptor material that is thermally reactive to an electromagnetic field. The method may further include covering at least a portion of the last with two or more footwear components, wherein the two or more footwear components includes the at least one footwear component formed at least in part from a susceptor material. In addition, the method may include applying an electromagnetic field to the susceptor material, causing induction heating of the susceptor material and joining the two or more footwear components by melding the two or more components with the induction heating.

In another aspect, the present disclosure is directed to a method of making an article of footwear. The method may include providing a last shaped to resemble a human foot. In addition, the method may include forming at least one footwear component at least in part from a susceptor material that is thermally reactive to an electromagnetic field. Also, the method may include covering at least a portion of the last with the at least one footwear component. Further, the method may include applying an electromagnetic field to the susceptor material, causing induction heating of the susceptor material and molding the at least one footwear component into a predetermined shape using the induction heating. In some embodiments, the footwear component formed at least in part from a susceptor material may be a heel counter, a toe cap, or a panel of an upper of the article of footwear.

In another aspect, the present disclosure is directed to a method of making an article of footwear. The method may include providing a last shaped to resemble a human foot. The method may also include forming at least one footwear component at least in part from a non-metallic susceptor material that is thermally reactive to an electromagnetic field. The method may also include covering at least a portion of the last with the at least one footwear component and applying an electromagnetic field to the susceptor material, causing induction heating of the susceptor material. In addition, the method may include subjecting the article of footwear to a metal detection process.

Advantages and features of novelty characterizing aspects of the presently disclosed embodiments are pointed out with particularity in the appended claims. Additional systems, methods, features, and advantages of the invention will be, or will become, apparent to one of ordinary skill in the art upon examination of the following descriptive matter and accompanying figures.

FIGURE DESCRIPTIONS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
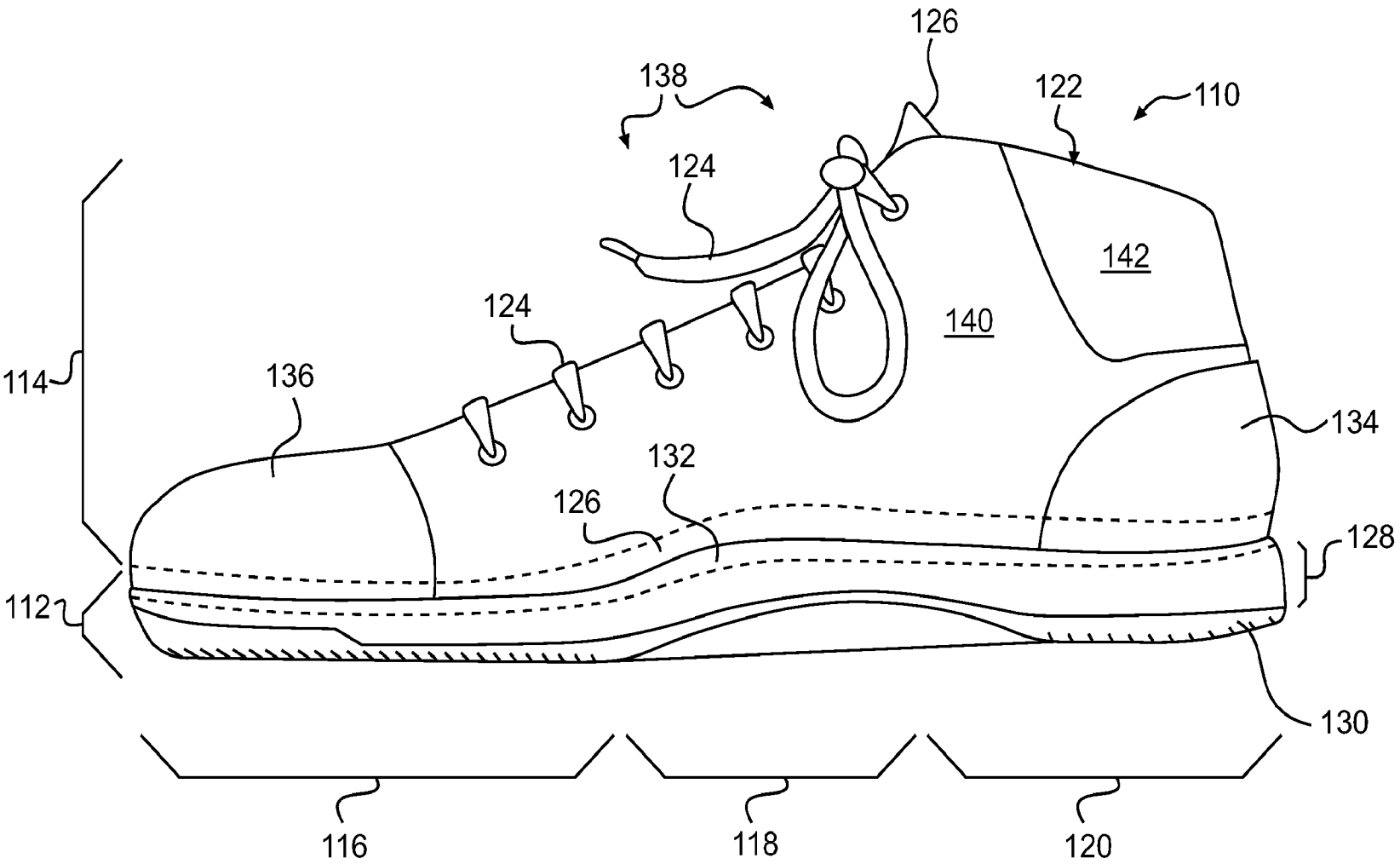
FIG. 1 is an elevation view of an exemplary article of footwear.

The following discussion and accompanying figures disclose systems and methods for manufacturing an article of footwear. Concepts associated with the disclosed systems and methods may be applied to a variety of footwear types, including athletic shoes, dress shoes, casual shoes, or any other type of footwear.

For consistency and convenience, directional adjectives are employed throughout this detailed description corresponding to the illustrated embodiments. The term "longitudinal," as used throughout this detailed description and in the claims, refers to a direction extending a length of an article of footwear, that is, extending from a forefoot portion to a heel portion. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of the footwear. In other words, the lateral direction may extend between a medial side and a lateral side of an article of footwear, with the lateral side of the article of footwear being the surface that faces away from the other foot, and the medial side being the surface that faces toward the other foot.

The term "horizontal," as used throughout this detailed description and in the claims, refers to any direction substantially parallel with the ground, including the longitudinal direction, the lateral direction, and all directions in between. Similarly, the term "side," as used in this specification and in the claims, refers to any portion of a component facing generally in a lateral, medial, forward, and/or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface. Further, it will be understood that each of these directional terms may be applied to, not only a complete article of footwear, but also to individual components of an article of footwear.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques. In addition, two components may be "fixedly attached" by virtue of being integrally formed, for example, in a molding process.

Footwear Structure

Since the present disclosure is directed to apparatuses and methods for manufacturing articles of footwear, various components of an article of footwear will be described in the following paragraphs for purposes of reference.

FIG. 1 depicts an article of footwear 110. The configuration of an article of footwear may vary significantly according to the type of activity for which the article of footwear is anticipated to be used. For example, in some embodiments, footwear may be anticipated to be used for athletic activities, such as running, jogging, and participating in sports. In some embodiments, the article of footwear may be configured for casual wear, such as running errands, attending school, or participating in a social event. In addition, the configuration of an article of footwear may vary significantly according to one or more types of ground surfaces on which the footwear may be used. For example, the footwear may be configured to have certain features and/or attributes depending on whether the footwear is anticipated to be used on natural outdoor surfaces, such as natural turf (e.g., grass), synthetic turf, dirt, snow; synthetic outdoor surfaces, such as rubber running tracks; or indoor surfaces, such as hardwood flooring/courts, rubber floors; and any other type of surface.

Footwear 110 is depicted in FIG. 1 as a high top sneaker, suitable for wear playing basketball, for example. However, the disclosed manufacturing apparatuses and methods may be applicable for manufacturing any type of footwear, including other types of athletic shoes, such as running shoes or cleated shoes; dress shoes, such as oxfords or loafers; casual shoes; or any other type of footwear.

As shown in FIG. 1, footwear 110 may include a sole structure 112 and an upper 114. For reference purposes, footwear 110 may be divided into three general regions: a forefoot region 116, a midfoot region 118, and a heel region 120. Forefoot region 116 generally includes portions of footwear 110 corresponding with the toes and the joints connecting the metatarsals with the phalanges. Midfoot region 118 generally includes portions of footwear 110 corresponding with an arch area of the foot. Heel region 120 generally corresponds with rear portions of the foot, including the calcaneus bone. Regions 116, 118, and 120 are not intended to demarcate precise areas of footwear 110. Rather, regions 116, 118, and 120 are intended to represent general relative areas of footwear 110 to aid in the following discussion. Since sole structure 112 and upper 114 both span substantially the entire length of footwear 110, the terms forefoot region 116, midfoot region 118, and heel region 120 apply not only to footwear 110 in general, but also to sole structure 112 and upper 114, as well as the individual elements of sole structure 112 and upper 114.

As shown in FIG. 1, upper 114 may include one or more material elements (for example, textiles, foam, leather, and synthetic leather), which may be stitched, adhesively bonded, molded, or otherwise formed to define an interior void configured to receive a foot. The material elements may be selected and arranged to selectively impart properties such as durability, air-permeability, wear-resistance, flexibility, and comfort. An ankle opening 122 in heel region 120 provides access to the interior void. In addition, upper 114 may include a lace 124, which may be utilized to modify the dimensions of the interior void, thereby securing the foot within the interior void and facilitating entry and removal of the foot from the interior void. Lace 124 may extend through apertures in upper 120, and a tongue portion 126 of upper 114 may extend between the interior void and lace 124. Upper 114 may alternatively implement any of a variety of other configurations, materials, and/or closure mechanisms. For example, upper 114 may include sock-like liners instead of a more traditional tongue; alternative closure mechanisms, such as hook and loop fasteners (for example, straps), buckles, clasps, cinches, or any other arrangement for securing a foot within the void defined by upper 114.

Sole structure 112 may be fixedly attached to upper 114 (for example, with adhesive, stitching, welding, and/or other suitable techniques) and may have a configuration that extends between upper 114 and the ground. Sole structure 112 may include provisions for attenuating ground reaction forces (that is, cushioning the foot). In addition, sole structure 112 may be configured to provide traction, impart stability, and/or limit various foot motions, such as pronation, supination, and/or other motions.

In some embodiments, sole structure 112 may include multiple components, which may individually and/or collectively provide footwear 110 with a number of attributes, such as support, rigidity, flexibility, stability, cushioning, comfort, reduced weight, and/or other attributes. In some embodiments, sole structure 112 may include an insole 126, a midsole 128, and a ground engaging sole component 130, as shown in FIG. 1. In some embodiments, midsole 128 may include a support plate 132. Insole 126 and support plate 132 are shown in broken lines in order to illustrate hidden boundaries of these components, not visible from the exterior of footwear 110. In some cases, one or more of these components of sole structure 112 may be omitted. Further, footwear 110 may also include a heel counter 134 and/or a toe cap 136 affixed to upper 114.

Insole 126 may be disposed in the void defined by upper 114. Insole 126 may extend through each of regions 116, 118, and 120 and between the lateral and medial sides of footwear 110. Insole 126 may be formed of a deformable (for example, compressible) material, such as polyurethane foams, or other polymer foam materials. Accordingly, insole 126 may, by virtue of its compressibility, provide cushioning, and may also conform to the foot in order to provide comfort, support, and stability.

In some embodiments, insole 126 may be removable from footwear 110, for example, for replacement or washing. In other embodiments, insole 126 may be integrally formed with the footbed of upper 114. In other embodiments, insole 126 may be fixedly attached within footwear 110, for example, via permanent adhesive, welding, stitching, and/or another suitable technique. In some embodiments of footwear 110, upper 114 may include a bottom portion defining a lower aspect of the void formed by upper 114. Therefore, in such embodiments, insole 126 may be disposed above the bottom portion of upper 114, inside the void formed by upper 114. In other embodiments, upper 14 may not extend fully beneath insole 126, and thus, in such embodiments, insole 126 may rest atop midsole 128 (or sole component 30 in embodiments that do not include a midsole).

Footwear 110 is depicted in FIG. 1 as having a midsole 128. The general location of midsole 128 has been depicted in FIG. 1 as it may be incorporated into any of a variety of types of footwear. Midsole 128 may be fixedly attached to a lower area of upper 114 (for example, through stitching, adhesive bonding, thermal bonding (for example, welding), and/or other techniques), or may be integral with upper 114. Midsole 128 may extend through each of regions 116, 118, and 120 and between the lateral and medial sides of footwear 110. In some embodiments, portions of midsole 128 may be exposed around the periphery of footwear 110, as shown in FIG. 1. In other embodiments, midsole 128 may be completely covered by other elements, such as material layers of upper 114. Midsole 128 may be formed from any suitable material having the properties described above, according to the activity for which footwear 110 is intended. In some embodiments, midsole 128 may include a foamed polymer material, such as polyurethane (PU), ethyl vinyl acetate (EVA), or any other suitable material that operates to attenuate ground reaction forces as sole structure 112 contacts the ground during walking, running, or other ambulatory activities.

In some embodiments, a midsole may include, in addition (or as an alternative) to cushioning components, such as foams discussed above, features that provide support and/or rigidity. In some embodiments, such features may include a support plate that extends at least part of the length of footwear 110.

As shown in FIG. 1, midsole 128 may include support plate 132. In some embodiments, support plate 132 may extend a portion of the length of footwear 110. In other embodiments, support plate 132 may extend substantially the entire length of footwear 110, as shown in FIG. 1.

Support plate 132 may be a substantially flat, plate-like platform. Support plate 132, although relatively flat, may include various anatomical contours, such as a relatively rounded longitudinal profile, a heel portion that is higher than the forefoot portion, a higher arch support region, and other anatomical features.

Support plate 132 may be formed of a relatively rigid plastic, carbon fiber, or other such material, in order to maintain a substantially flat surface upon which the forces applied by a foot during ambulatory activities may be distributed. Support plate 132 may also provide torsional stiffness to sole structure 112, in order to provide stability and responsiveness.

A ground-contacting sole component may include features that provide traction, grip, stability, support, and/or cushioning. For example, a sole component may have ground-engaging members, such as treads, cleats, or other patterned or randomly positioned structural elements. A sole component may also be formed of a material having properties suitable to provide grip and traction on the surface upon which the footwear is anticipated to be used. For example, a sole component configured for use on soft surfaces, may be formed of a relatively hard material, such as hard plastic. For instance, cleated footwear, such as soccer shoes, configured for use on soft grass may include a sole component made of hard plastic, having relatively rigid ground engaging members (cleats). Alternatively, a sole component configured for use on hard surfaces, such as hardwood, may be formed of a relatively soft material. For example, a basketball shoe configured for use on indoor hardwood courts may include a sole component formed of a relatively soft rubber material.

Sole components may be formed of suitable materials for achieving the desired performance attributes. Sole components may be formed of any suitable polymer, composite, and/or metal alloy materials. Exemplary such materials may include thermoplastic and thermoset polyurethane (TPU), polyester, nylon, polyether block amide, alloys of polyurethane and acrylonitrile butadiene styrene, carbon fiber, poly-paraphenylene terephthalamide (para-aramid fibers, e.g., Kevlar®), titanium alloys, and/or aluminum alloys. In some embodiments, sole components may be formed of a composite of two or more materials, such as carbon-fiber and poly-paraphenylene terephthalamide. In some embodiments, these two materials may be disposed in different portions of the sole component. Alternatively, or additionally, carbon fibers and poly-paraphenylene terephthalamide fibers may be woven together in the same fabric, which may be laminated to form the sole component. Other suitable materials and composites will be recognized by those having skill in the art.

The sole component may be formed by any suitable process. For example, in some embodiments, the sole component may be formed by molding. In addition, in some embodiments, various elements of the sole component may be formed separately and then joined in a subsequent process. Those having ordinary skill in the art will recognize other suitable processes for making the sole components discussed in this disclosure.

As shown in FIG. 1, sole component 130 may be disposed at a bottom portion of footwear 110 and may be fixedly attached to midsole 128. In embodiments of footwear 110 without a midsole, sole component 130 may be fixedly attached to upper 114.

An upper of an article of footwear may be formed of one or more panels. In embodiments that combine two or more panels, the panels may be fixedly attached to one another. For example, upper panels may be attached to one another using stitching, adhesive, welding, and/or any other suitable attachment technique.

As shown in FIG. 1, upper 114 may include one or more upper panels 138. For example, in some embodiments, upper 114 may be made from a single panel. In other embodiments, upper 114 may be formed of multiple panels. For example, upper 114 may include a first upper panel 140 and a second upper panel 142. The shape and size of upper panels 138 may have any suitable form, and those skilled in the art will recognize various possible shapes and sizes for upper panels 138 other than those shown in FIG. 1.

Upper 114 may be formed out of any suitable materials. For example, upper panels 138 may be formed of such materials as leather, canvas, rubber, polyurethane, vinyl, nylon, synthetic leathers, and/or any other suitable material. In some cases, footwear 110 may be formed out of multiple panels in order to facilitate assembly of footwear 110. In some embodiments, multiple panels may be used for upper 114 in order to enable different materials to be used in different parts of upper 114. Different materials may be chosen for different panels of footwear 110 based on factors such as strength, durability, flexibility, breathability, elasticity, and comfort.

In addition, in some embodiments, footwear may include other footwear components, such as a heel counter and/or a toe cap. In some cases, components such as heel counters and/or toe caps may be upper panels. In other cases, heel counters and/or toe caps may be separate components added to an upper.

In some embodiments, an article of footwear may include a heel counter to provide support and stability to the heel and ankle regions of the foot. In some embodiments, the heel counter may be disposed on an outside portion of the upper. In other embodiments, the heel counter may be disposed in between layers of the upper. The heel counter may be formed of a relatively rigid material, configured to stiffen the rear section of an article of footwear, including the heel region. In some embodiments, the heel counter may include a U-shaped structure configured to wrap around the lateral, rear, and medial portions of the heel region of the footwear. In some embodiments, the heel counter may also include a bottom portion configured to be disposed under the heel region of the upper.

As shown in FIG. 1, footwear 110 may include heel counter 134. Heel counter 134 may be fixedly attached to upper 114 in heel region 120 of footwear 110. For example, heel counter 134 may wrap around the lateral, rear, and medial sides of heel region 120. Heel counter 134 may be formed of a suitably rigid material, such as hard plastic, carbon fiber, stiff cardboard, or any other type of relatively rigid material. In some embodiments, heel counter 134 may be attached to an exterior of upper 114 with adhesive, stitching, welding, or another suitable fastening technique. Heel counter 134 may have a pre-formed shape, or may be shaped/molded in conjunction with its attachment to upper 114, as will be discussed in greater detail below.

In some embodiments an article of footwear may include a toe cap disposed at a toe region of the footwear. In some embodiments, the toe cap may be a panel of an upper. In other embodiments, the toe cap may be a layer of the upper. In still other embodiments, the toe cap may be a covering applied on top of the upper. The toe cap may provide additional reinforcement in the toe region, to resist scuffing and/or protect the toes.

As shown in FIG. 1, footwear 110 may include toe cap 136 in forefoot region 116 of upper 114. Toe cap 136 may be formed of any suitable material, such as the materials mentioned above regarding upper 114. In some embodiments, toe cap 136 may be formed of a stronger, stiffer, and/or more durable material than other portions of upper 114. In other embodiments, toe cap 136 may be formed of a material that is more flexible, more breathable, and/or lighter weight than other portions of upper 114.

An article of footwear such as footwear 110 shown in FIG. 1 and described above can be manufactured with a variety of manufacturing techniques. The following discussion describes exemplary apparatuses and methods of manufacturing an article of footwear using induction heating.

Manufacturing Apparatus

An apparatus for making an article of footwear may include a last shaped to resemble a human foot. During the manufacturing process, one or more footwear components, such as panels of an upper, toe caps, heel counters, midsole components, and/or ground-contacting sole components may be mounted on the last, in order to form the article of footwear having an interior shape corresponding with the outer shape of the last. The apparatus may be further configured to join and/or mold footwear components covering the last using induction heating. In order to do so, the apparatus may include a last on, or against, which footwear components may be mounted; a support block for supporting footwear components by holding the components against the last, and an induction coil for inductively heating susceptor material in the last. When held against the inductively heated last, footwear components may be heated in order to join footwear components together, or mold footwear components into a predetermined shape.

Figure 2:
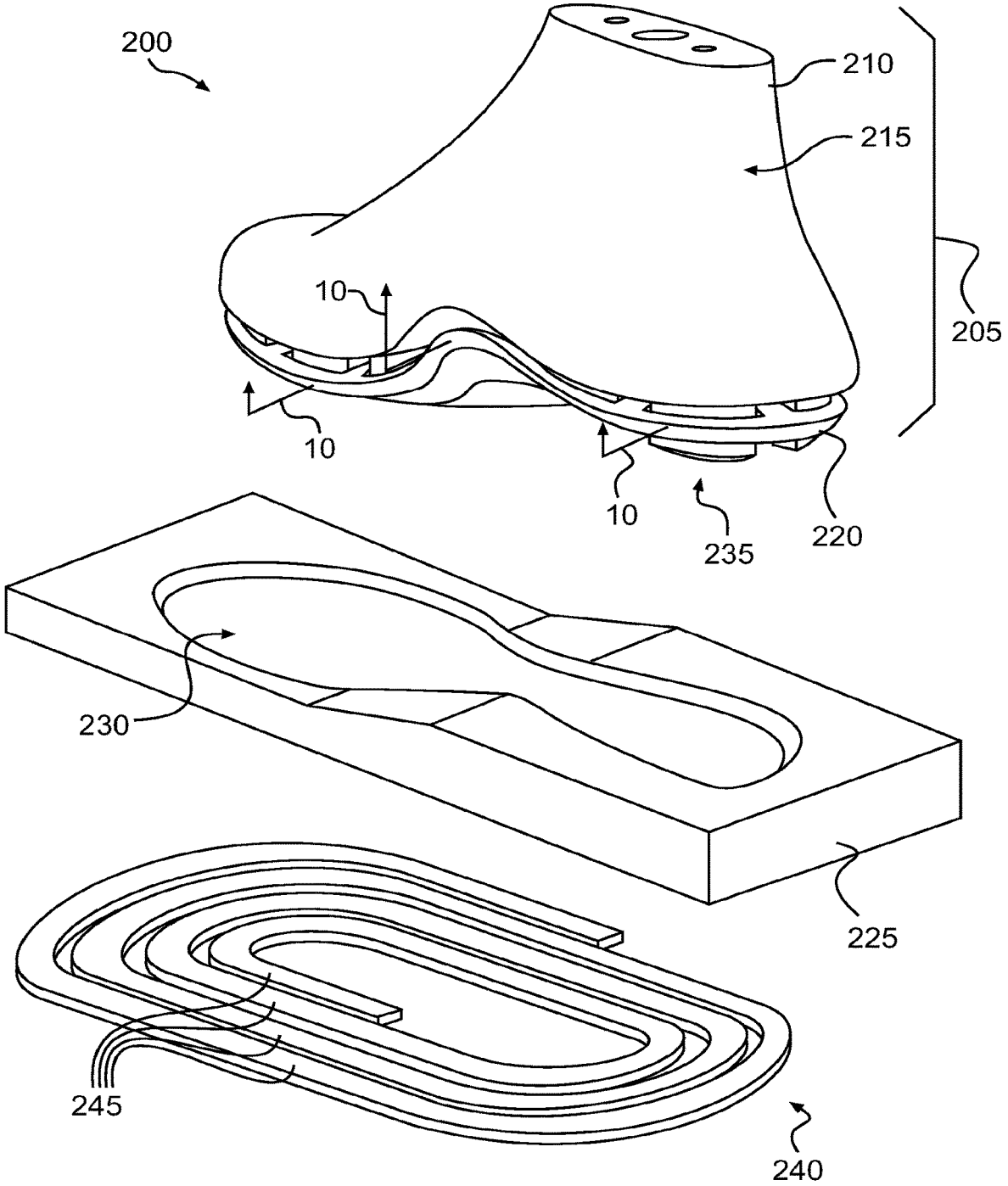
FIG. 2 is an exploded perspective view of an apparatus for manufacturing an article of footwear.

FIG. 2 is an exploded view of components of an apparatus 200 for making an article of footwear. Apparatus 200 may include a last 205. As shown in FIG. 2, last 205 may be shaped to resemble a human foot. In some embodiments, last 205 may be shaped to resemble a certain person's foot. For example, custom shoes may be made for an individual person using lasts made from molds taken of that person's feet. In other embodiments, last 205 may have a shape corresponding to a certain foot type (for example, narrow feet, wide feet, high arches, high insteps, and other various foot types). Lasts with a shape corresponding to a certain foot type may not be shaped like any one foot. Rather, such lasts may have dimensions that are averages of many different feet. For example, a last having a narrow foot type shape, may have dimensions that are averages of the dimensions of many different feet considered to be relatively narrow. The averaged dimensions result in a last that is not shaped like any particular foot, but rather has a shape that is generically that of a narrow foot type. Thus, articles of footwear assembled on such a last may be formed with an interior shape that fits a broad range of wearers having relatively narrow feet, even though each wearer's feet are unique. In some embodiments, last 205 may have a shape with dimensions that are averages of dimensions of many different feet having a variety of foot types. Such a shape may facilitate the manufacture of footwear that may fit a broad range of wearers having a wide variety of foot types.

The averaged dimensions result in a last that is not shaped like any particular foot. Such a last may have less surface detail than an actual foot and the contours of the last may be smoothed out in comparison to an actual foot. The result may be a last that appears, to some extent, like a mannequin or doll foot. Nevertheless, for purposes of this description and the appending claims, a last shall be considered to "resemble a human foot" not only when the last is shaped like a specific foot, but also when the last is shaped with dimensions that are averages of multiple feet. Persons of ordinary skill in the art will readily recognize the practice of forming lasts with averaged dimensions, and will, accordingly, appreciate the meaning of the term "resemble a human foot," as used in the present description and claims.

In some embodiments, the last may be formed of a single piece of material. In other embodiments, the last may be formed of multiple components. In some embodiments different last components may be formed of different materials. In some embodiments, the last may include a first component. An outer surface of the first component may form a substantial majority of the outer shape of the last. The first component may have a relatively low electrical conductivity, and thus, may be resistant to induction heating. Exemplary materials from which the first component of the last may be formed include plastics, wood, rigid foams, and other relatively rigid materials having relatively low electrical conductivity.

In addition, in exemplary embodiments, in order to facilitate induction heating, the last may be formed, at least in part, from a susceptor material that is thermally reactive to an electromagnetic field. For example, the susceptor material may be a material that increases in temperature when exposed to an electromagnetic field. Exemplary such materials are electrically conductive materials. Accordingly, exemplary susceptor materials may include metals, such as aluminum, steel, and copper; metallic compounds, such as boron carbide, tin oxide, and zinc oxide; and/or other electrically conductive materials, such as graphite and other carbon-based materials. Other susceptor materials usable with the presently disclosed apparatuses and methods will be recognized by skilled artisans.

Some exemplary susceptor materials may include ferromagnetic materials. For example, a susceptor component may be formed at least in part of ferromagnetic particles. In some cases such particles may be nanoparticles. Susceptor particles may be integrally mixed with component materials, such as plastics. In some cases, susceptor particles may be mixed with granular component materials.

Some footwear manufacturing processes involve use of metal detectors for quality control. In some cases, non-metallic susceptor materials may be used in order to permit use of metal detectors without reducing the effectiveness of the metal detection for quality control purposes.

In some embodiments, the last may be formed substantially entirely of a susceptor material. In other embodiments, substantially the entire last may be formed of a material that is impregnated with a susceptor material. In still other embodiments, the last may include a susceptor component separate from the first component of the last. Such a separate susceptor component may be formed entirely from a susceptor material, may be impregnated with a susceptor material, or may include sub-components that are formed, at least in part, from a susceptor material.

There are several advantages to utilizing induction heating over other heating techniques, such as conduction heating and convection heating, for certain footwear manufacturing processes, such as joining and/or molding of footwear components. In conduction heating (the transfer of heat through materials) and convection heating (the transfer of heat from one component to air or another medium, which then transfers the heat to another component), the heating may be wide spread across an entire object regardless of which type of materials it is made from. In addition, such processes can be relatively slow, and may not be well-suited for evenly heating an object. It can take a relatively long time for thermal energy to evenly distribute from portions of an object closest to the heat source to portions of the object furthest from the heat source. In addition, it may be difficult to heat objects evenly with conduction and convection, regardless of how long the process is conducted, as portions closer to the heat source may exhibit larger temperature increases. Also, conduction and convection heating processes can be inefficient, requiring large amounts of energy to effectuate relatively small increases in temperature.

In contrast to conduction and convection heating, induction heating may be better suited to selectively heating certain portions of an object. With induction heating, the site of heating may be determined by the placement of susceptor materials, for example, in the manufacturing apparatus (such as in the last) or in the footwear components themselves. Thus, induction heating may be utilized to join and/or mold select portions of an article of footwear or select portions of footwear components. For example, induction heating may be utilized to selectively heat only adjoining portions of two footwear components, in order to join the two components. In addition, select portions of an article of footwear, such as a toe cap or heel region, may be molded using induction heating, without affecting other portions of the article of footwear. Because select portions of an article of footwear may be heated, joining and/or molding processes may be performed while the article of footwear is in an advanced stage of assembly. For example, joining or molding processes may be performed on one part of an article of footwear, even though a substantial portion of the rest of the article of footwear has already been assembled, because the heating may be focused on the areas to be joined or molded, without heating other portions of the footwear.

Induction heating may also be a relatively fast process by which an object may be heated evenly. Since the susceptor material heats due to the flow of eddy currents and the electrical resistance of the susceptor material, the susceptor material heats relatively evenly, compared to conduction or convention heating processes. Not only does heating occur evenly in the susceptor material, but also, it occurs in a relatively short amount of time, because there is no delay due to thermal conduction or convection. Faster heating may result in thermoset materials reaching thermoset activation temperatures more quickly. This may hasten molding processes. In other processes, faster heating may result in materials reaching a melting/welding temperature more quickly, which may hasten joining procedures.

Similarly, cooling processes may be more rapid because only the object including the susceptor material is heated. Thus, other portions of the footwear, as well as the mold forms, remain at a lower temperature and need not be cooled. Further, the cool mold forms will immediately begin cooling and setting the heated components after the heating is stopped. Accordingly, the article of footwear can be cooled without being transferred to a cooling mold. This may result in faster production cycle times, and use of less production floor space.

In addition, heating only select portions of an article of footwear, such as a heel counter, may enable a larger selection of upper materials. That is, certain upper materials may have desirable performance properties but may not withstand heating to a desired extent. With generalized heating, such as conductive heating, heat-sensitive upper materials are not usable. With component-specific induction heating, a plastic heel counter may be heated without heating an upper material. Thus, a wider variety of upper materials may be used.

Another advantage of induction heating over conduction heating is that the heating may be performed without physically touching the object to be heated with any kind of heating device. For example, conduction heating may be performed using an electrical heating element. However, the electrical heating element is typically brought into contact with the object to be heated in order to conductively heat it. This may place restrictions on options for carrying out heating aspects of footwear manufacturing processes. Thus, a non-contact form of heating may be desired. An electrical heating element, as well as other heating devices, can be used to effectuate convection heating, by placing the heating device in proximity to, but not touching, the object to be heated. However, as noted above, convection heating is a relatively slow process.

Other forms of non-contact heating are also known. For example, irradiative heating may be performed using infrared (IR) or microwave irradiation. However, there are advantages of induction heating over these types of heating as well.

Infrared heating involves heating objects by irradiation with infrared light waves. The infrared light transmits energy via radiation, as opposed to conduction or convection. Infrared irradiation may provide non-contact heating, and may also provide targeted heating of an object. Infrared heating also does not require a medium for transmission. That is, the energy is not transferred by heating air, for example, but rather transmits the energy directly to the object to be heated with radiation, which happens to travel through the air. However, infrared irradiation is applied to the surface of an object. The thermal energy must then propagate through the remainder of the object via thermal conduction, which, as noted above, can be a relatively slow and uneven heating process. Consequently, infrared irradiation is not well-suited for application to blind surfaces (surfaces not exposed to the infrared irradiation) or other non-exposed portions of the object. This can be limiting for footwear manufacturing, as non-exposed portions of footwear components (for example overlapping panels of an upper) may not be conducive to heating with infrared irradiation.

Microwave irradiation causes dielectric heating by agitating molecules in the irradiated material. Although microwave irradiation involves the application of electromagnetic waves, it is distinguishable from induction heating, because microwave irradiation results in dielectric heating instead of Joule heating (heating due to the flow of eddy currents in a conductive material) which is caused by induction heating. When conductivity of the material is relatively low and/or frequency of the electromagnetic waves is high, dielectric heating (not Joule heating) is the dominant mechanism of loss. Thus, a skilled artisan would recognize the difference between induction heating and microwave irradiation heating. Accordingly, for purposes of this description and the appended claims, the term "induction heating" shall refer to the use of an electromagnetic field and a susceptor material to induce Joule heating, and shall not encompass microwave irradiation heating.

It is further noted that, because microwave irradiation is more suited for heating materials with a low electrical conductivity (such as foods), it is not well-suited for selectively heating portions of an article of footwear, since most footwear materials have a relatively low electrical conductivity. Thus, heating an article of footwear with microwave irradiation may tend to heat many portions of the footwear, instead select portions to be joined or molded, for example. Induction heating, on the other hand, is more effective on more electrically conductive materials. Therefore, with induction heating, such electrically conductive materials may be selectively placed in a footwear manufacturing apparatus (for example a last) or into components of the article of footwear itself, in order to localize the heating.

In some embodiments, last 205 may be formed at least in part from a susceptor material that is thermally reactive to an electromagnetic field. As shown in FIG. 2, in some embodiments, last 205 may include a first component 210 having an outer surface 215 defining a substantial majority of an outer shape of last 205. In some embodiments, first component 210 may be formed of a non-susceptor material (that is, a material with low electrical conductivity). In addition, in some embodiments, last 205 may include a susceptor component 220, as shown in FIG. 2. Susceptor component 220 may be formed, at least in part, of a susceptor material that increases in temperature upon exposure to an electromagnetic field due to induction heating. Thus, in embodiments where first component 210 is formed of a non-susceptor material, an electromagnetic field will cause induction heating in susceptor component 220, and not in first component 210 of last 205. Therefore, targeted heating may be accomplished by select placement of susceptor component 220 in last 205.

The footwear making apparatus may be configured to apply pressure between the last and a support block in order to facilitate attachment of footwear components, such as sole structure components, to an upper (or portions of an upper) that are covering the last. Additionally, or alternatively, the footwear making apparatus may be configured to facilitate molding of the sole structure components against the last. Accordingly, the apparatus may include a support block configured to support one or more footwear components by holding the footwear components against the last during induction heating. For example, an exemplary support block may be configured to cradle sole structure components, such as support plates and/or ground contacting sole components. Accordingly, the support block may include features to facilitate this. For example, the support block may include a foot sole-shaped depression configured to mate with a sole portion of the last.

As shown in FIG. 2, apparatus 200 may include a support block 225. Support block 225 may be configured to support one or more sole structure components, by cradling the sole structure components. For example, support block 225 may include a foot sole-shaped depression 230 configured to mate with a sole portion 235 of last 205. One or more actuator devices (not shown) may apply pressure between last 205 and support block 225. In some embodiments, an actuator may apply pressure down upon last 205. In other embodiments, an actuator may apply pressure to support block 225. In still other embodiments, pressure may be applied to both last 205 and support block 225. By holding footwear components against last 205 during induction heating, the application of pressure may be distributed relatively evenly across the mating surfaces of footwear components.

In some embodiments, the support block may be a rigid form configured to hold a footwear component against the last. In other embodiments, the support block may include one or more soft forms in order to force the footwear component against the last, allowing the last (and any other footwear components mounted on the last) to determine the shape of the footwear component joined and/or molded in the induction heating process. For example, the support block may have a soft, gel-like, or inflatable liner. In other embodiments, the support block may include a cabinet having inflatable walls that, when inflated, close relatively tightly around the last, pressing footwear components against the outer surface of the last. Other configurations of devices for supporting footwear components will be recognized by those having ordinary skill in the art.

The apparatus may further include an induction coil configured to generate an electromagnetic field. When exposed to the electromagnetic field, the susceptor material increases in temperature, thus heating at least a portion of the last. In some embodiments, this induction heating of the last may be utilized to join two or more footwear components. In some embodiments, induction heating of the last may be utilized to effectuate molding of footwear components. In some embodiments, induction heating may be utilized for both joining and molding footwear components.

FIG. 2 shows an exemplary induction coil 240. Induction coil 240 may be disposed proximate to last 205 and may be configured to produce an electromagnetic field that causes the susceptor material in last 205 to increase in temperature by induction heating. As shown in FIG. 2, induction coil 240 may include a plurality of coils 245. The number, size, and type of coils 245 may be selected to provide an electromagnetic field with characteristics suitable to effectuate induction heating in susceptor materials in last 205.

In some embodiments, induction coil 240 may be a separate component from support block 225, as shown in FIG. 2. In other embodiments, induction coil 240 may be incorporated into support block 225. For example, in some embodiments, induction coil 240 may be embedded into an interior of support block 225. In some embodiments, at least a portion of induction coil 240 may be disposed on a surface of support block 225, for example, within sole-shaped depression 230. Placing induction coil 240 in a location in close proximity to the susceptor components, such as in depression 230, which is close to susceptor component 220 when apparatus 200 is assembled for use, may enable less energy to be used to create a magnetic field that will cause the desired amount of heating in susceptor component 220. Those having ordinary skill in the art will recognize suitable configurations for induction coil 240.

In some configurations, induction coil 240 may be located in last 205. For example, induction coil 240 may be embedded into an interior of last 205. In some configurations, at least a portion of induction coil 240 may be located on a surface of last 205, as discussed in greater detail below (see discussion of FIG. 35). Accordingly, in some configurations, both susceptor component 220 and induction coil 240 may be incorporated into last 205.

Figure 3:
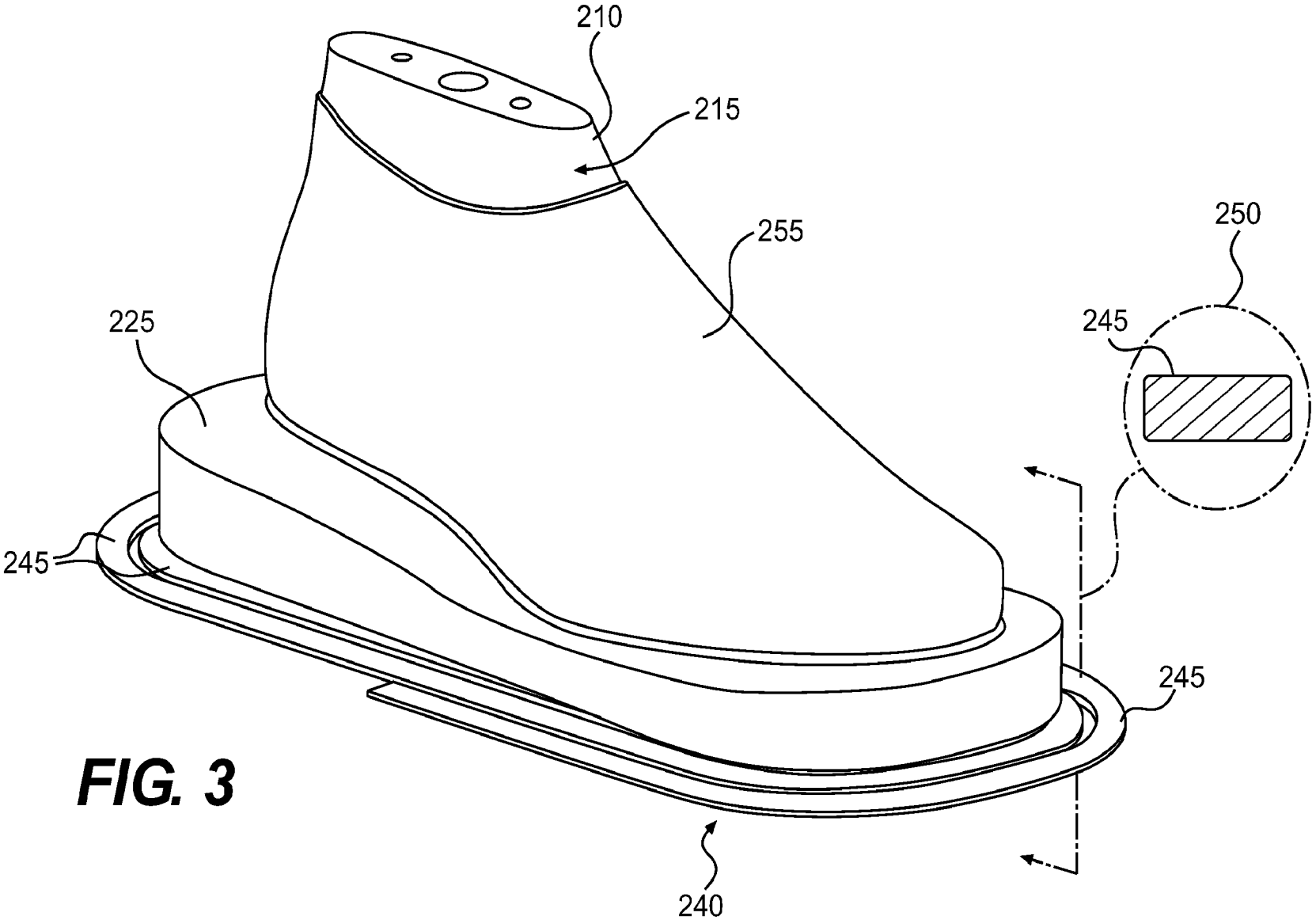
FIG. 3 is a perspective view of an apparatus for making an article of footwear assembled for executing a heating process.

In some embodiments, induction coil 240 may have a substantially planar shape, as shown in FIG. 2. That is, all of coils 245 may be disposed substantially in the same plane. FIG. 3 illustrates the components of apparatus 200 arranged for an induction heating procedure. As shown in FIG. 3, an upper 255 may be partially covering last 205. In some embodiments, induction coil 240 may be configured to be disposed proximate one side of the last. For example, as shown in FIG. 3, induction coil 240 may be disposed on a bottom side of last 205. In some embodiments, last 205 and, in some cases, support block 225 may rest upon induction coil 240. However, induction coil 240 may be disposed on any side of last 205 that is suitable for achieving the desired induction heating. Suitable placement of induction coil 240 may be determined in view of such considerations as, for example, the location on the last at which the susceptor material is disposed. For example, in some embodiments, it may be advantageous to locate induction coil 240 closer to the susceptor material. In addition, the orientation of a planar induction coil, such as induction coil 240, may influence the characteristics of the electromagnetic field that it produces. This may also be taken into consideration when selecting placement of induction coil 240.

In some embodiments, induction coil 240 may be integrated into a heating device. For example, in some cases, induction coil 240 may be a component of a hot plate or other similar equipment.

In addition, the cross-sectional shape of coils 245 may vary. In some embodiments, coils 245 may have a relatively flat and/or oblong cross-sectional shape, as shown in an enlarged cross-sectional view 250 in FIG. 3.

Induction coils may have any of a variety of shapes. In some embodiments, the induction coil may have a substantially tubular shape with a hollow central void that is configured to receive the last with one or more components of an article of footwear covering at least a portion of the last. Such a coil may be suitable for producing an electromagnetic field that is relatively even about the surface of the last. This may be beneficial for joining and/or molding footwear components that cover more than one side of the last.

Figure 4:
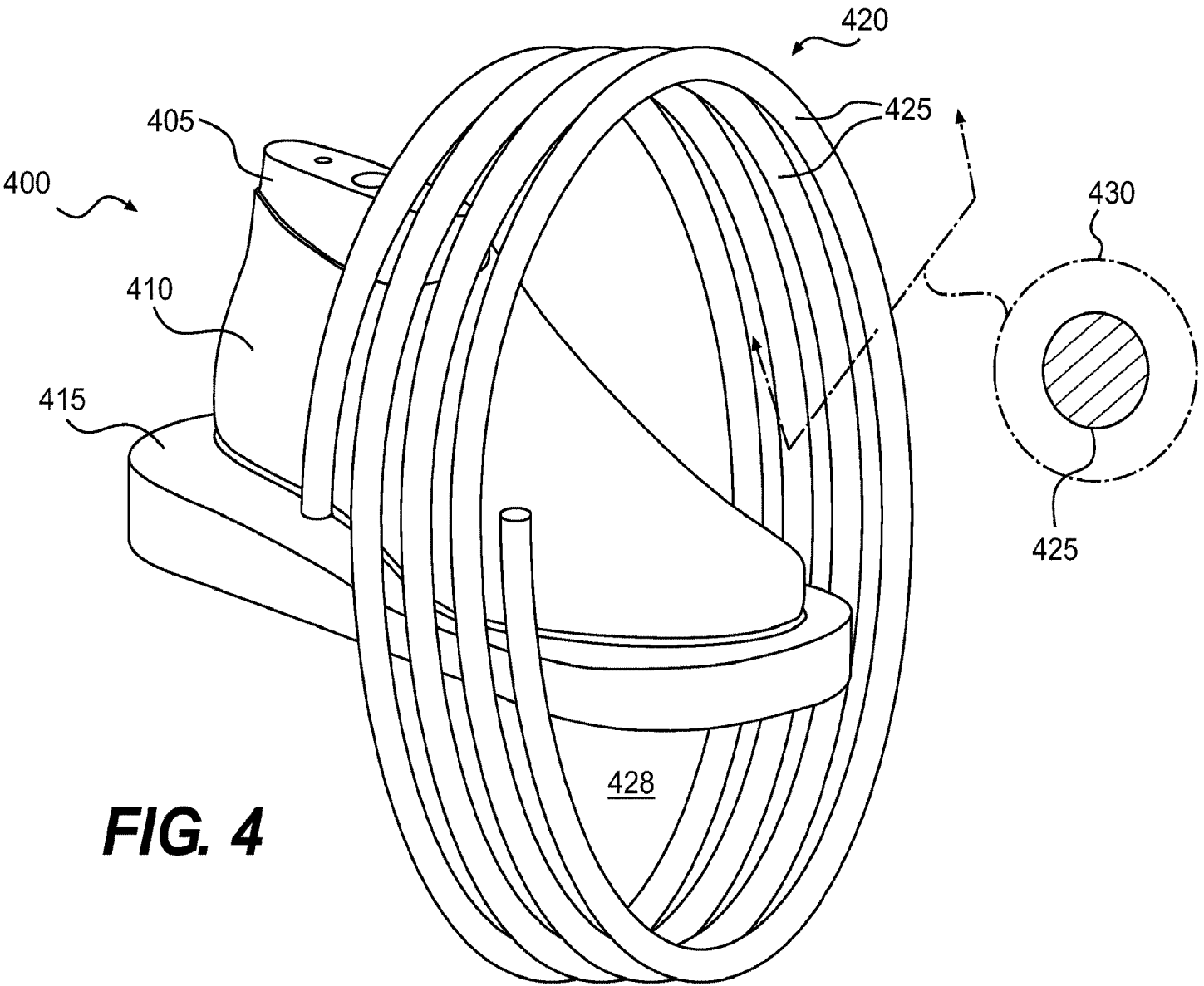
FIG. 4 is a perspective view of an alternative apparatus for making an article of footwear.

FIG. 4 shows an apparatus 400 for making an article of footwear. Apparatus 400 may include an alternative induction coil embodiment with a different type of induction coil. Apparatus 400 may include a last 405, an upper 410, a support block 415, and an induction coil 420. As shown in FIG. 4, induction coil 420 may have a substantially tubular shape. For example, induction coil 420 may include a plurality of coils 425 wound helically, or otherwise, to form a tubular configuration, thus forming a hollow central void 428 that is configured to receive last 405 with one or more footwear components covering at least a portion of last 405. As also shown in FIG. 4 in an enlarged cross-sectional view 430 of one of coils 425, in some embodiments, coils 425 may have a substantially circular cross-sectional shape. Other possible configurations of induction coil 420 will be recognized by skilled artisans.

Susceptor components may be disposed in any suitable location of the last, and may have any suitable size for effectuating the induction heating desired to be produced and transmitted to footwear components. In some embodiments, the susceptor components may be disposed to form a portion of the outer surface of the last. Disposed on the outer surface, susceptor components may directly contact footwear components mounted on the last, thus facilitating conduction of heat that has been inductively produced in the susceptor components to the footwear components. In addition, susceptor components may be located in areas of the last upon which footwear components that are desired to be heated will be mounted. For example, in some embodiments, midsole components and/or a ground-contacting sole component may be desired to be joined to a bottom (sole) portion of an upper. Therefore, in some embodiments, the last may include a susceptor component in the sole region of the last in order to transfer inductively produced heat from the susceptor component to sole structure components held adjacent the sole portion of the upper.

Figure 5:
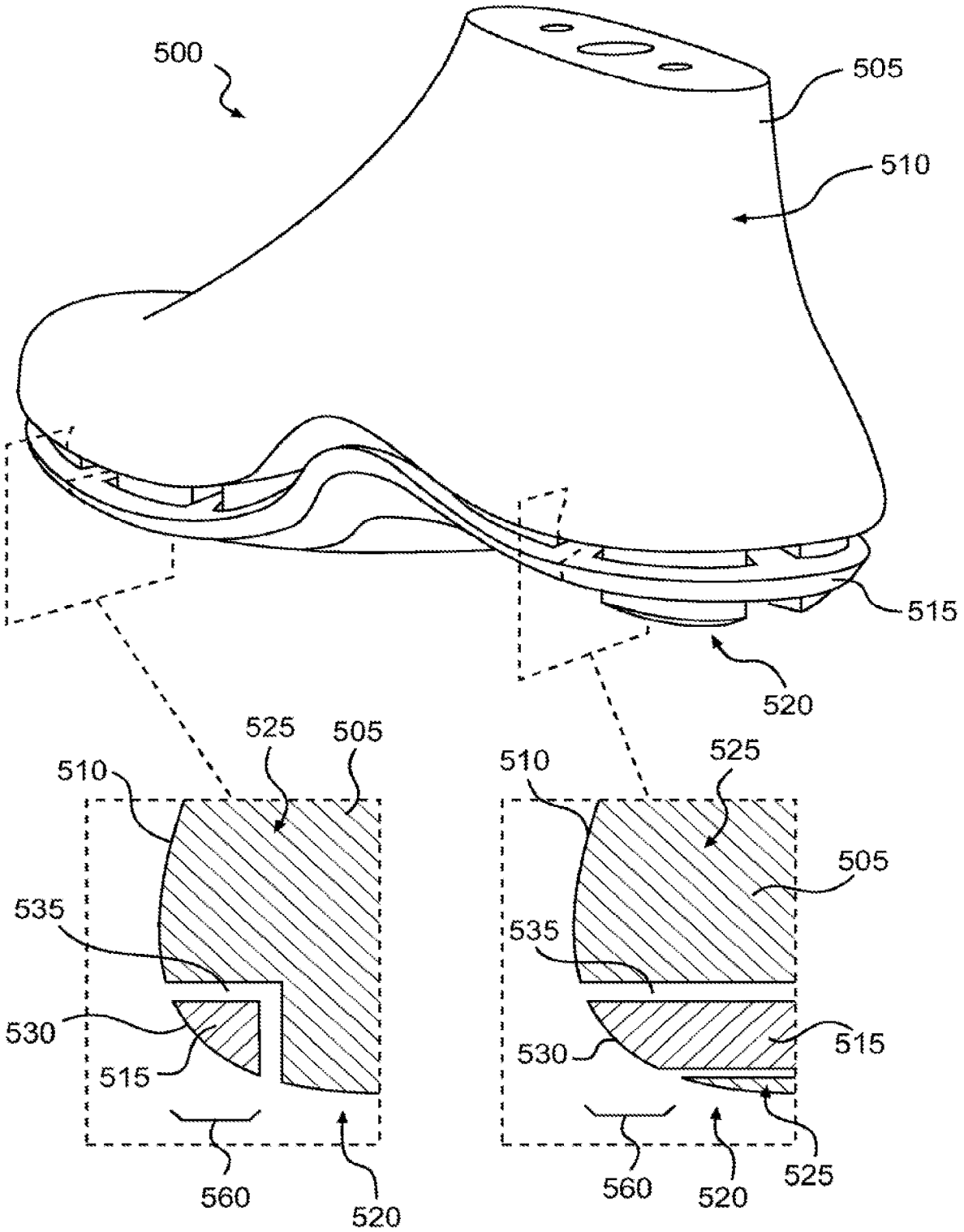
FIG. 5 is a schematic illustration of a perspective view of an exemplary last including a susceptor component.

FIG. 5 illustrates an apparatus 500 for making an article of footwear. Apparatus 500 may include a last 505. Last 505 may include an outer surface. In some embodiments, last 505 may be formed of multiple components. Therefore, the outer surface of last 505 may be formed of multiple surfaces that collectively form the outer shape of last 505. For example, in some embodiments, last 505 may include a first component 525 having an outer surface 510. Outer surface 510 of first component 525 may define a substantial majority of the outer shape of last 505. For example, since last 505 may be shaped to resemble a human foot, the outer surface 510 of first component 525 may define a substantial majority of the foot shape in which last 505 is formed.

In addition to first component 525, apparatus 500 may also include a susceptor component 515. As shown in FIG. 5, susceptor component 515 may form a portion of outer surface 510 of last 505. Last 505 may include a sole region 520 resembling the bottom of a foot. In some embodiments, susceptor component 515 may be disposed at a peripheral portion 560 of sole region 520. A susceptor component, such as susceptor component 515, disposed at a peripheral portion of a sole region of a last may facilitate application of heat to areas of footwear components, such as the outer boundaries of sole structure components.

It may be desirable to prevent heating of non-susceptor components of the last. Preventing heating of non-susceptor components may prevent damage to such components, and may also prevent transfer of heat to portions of footwear components that are not desired to be heated. This may facilitate the targeted application of heat to only portions of footwear components that are desired to be heated. To this end, in some embodiments, susceptor components of the last may be spaced from non-susceptor components of the last. By maintaining gaps between susceptor components and non-susceptor components, conductive heat transfer from susceptor components to non-susceptor components can be prevented.

In some embodiments, susceptor components may be connected to non-susceptor components of the last in relatively small areas in order to limit the amount of surface contact and, therefore, thermal conduction, between the components. In addition, in some embodiments, the connection points between susceptor components and non-susceptor components may be located in an interior portion of the last. Accordingly, in such embodiments, heat that may be conductively transferred from the susceptor components to the non-susceptor components may be localized in portions of the last that are remote from the outer surface of the last. Therefore, since footwear components are mounted on an outer surface of the last, preventing or limiting the transfer of heat to outer surface portions of non-susceptor components of the last may prevent the transfer of heat to portions of footwear components that are not desired to be heated.

As illustrated in FIG. 5, in some embodiments, an outer surface 530 of susceptor component 515 may form a portion of the outer shape of last 505. In addition, in some embodiments, outer surface 530 of susceptor component 515 may be completely isolated from outer surface 510 of first component 525 of last 505. For example, as shown in FIG. 5, last 505 may be configured to have a gap 535 between susceptor component 515 and first component 525 of last 505. Thus, the outer regions of susceptor component 515 and the outer regions of first component 525 may be independent of one another.

While the outer regions of susceptor component 515 and the outer regions of first component 525 may be independent of one another, susceptor component 515 and first component 525 may be connected at certain points. However, these points may be located substantially remote from the outer surface of last 505. Susceptor component 515 may include an outer portion 540 disposed at an outer region of last 505. Outer portion 540 of susceptor component 515 may include outer surface 530, which may form at least a portion of the outer shape of last 505. Susceptor component 515 may include an inner portion 550 extending in an inward direction away from outer surface 530 of susceptor component 515. Outer portion 540 may include an outer rail 555 disposed at a peripheral portion 560 of sole region 520 of last 505. Inner portion 550 may include one or more inner rails 565 extending inward from an inner surface 570 of outer rail 555.

Figure 6:
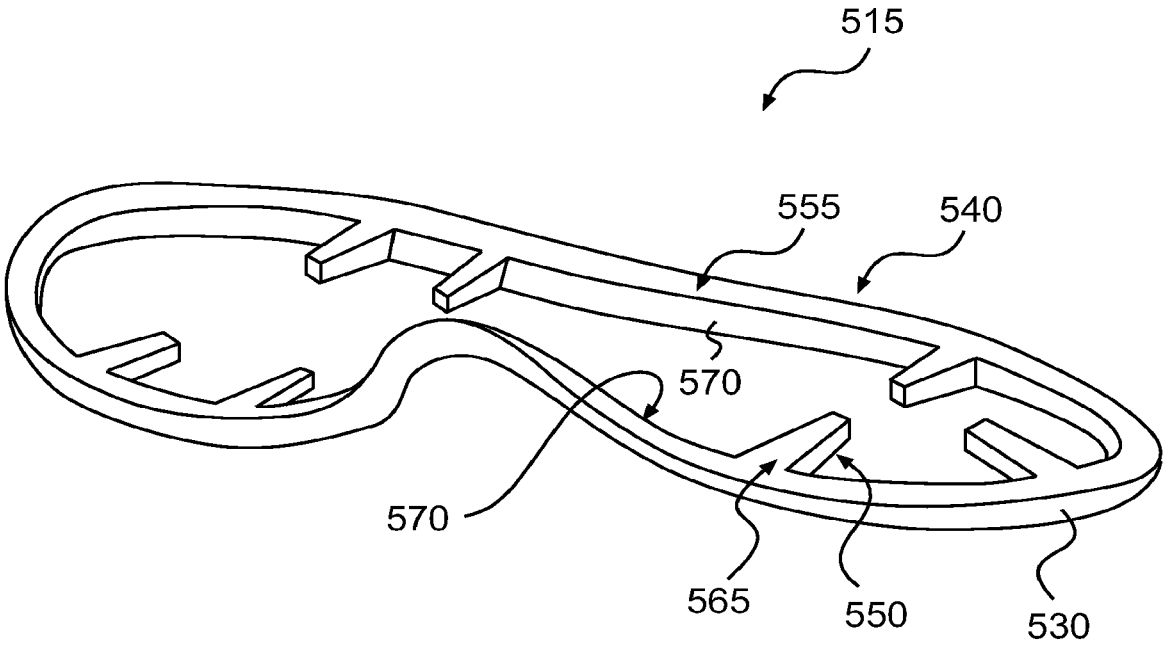
FIG. 6 is a perspective view of an exemplary susceptor component.

FIG. 6 is a perspective, medial side view of susceptor component 515. As shown in FIG. 6, susceptor component 515 may include outer portion 540 configured to be disposed at an outer region of last 505. Outer portion 540 may include outer surface 530 forming at least a portion of the outer shape of last 505. In addition, susceptor component 515 may include inner portion 550 extending in an inward direction away from outer surface 530 of susceptor component 515. FIG. 6 also depicts inner rails 565 extending inward from inner surface 570 of outer rail 555.

Figure 7:
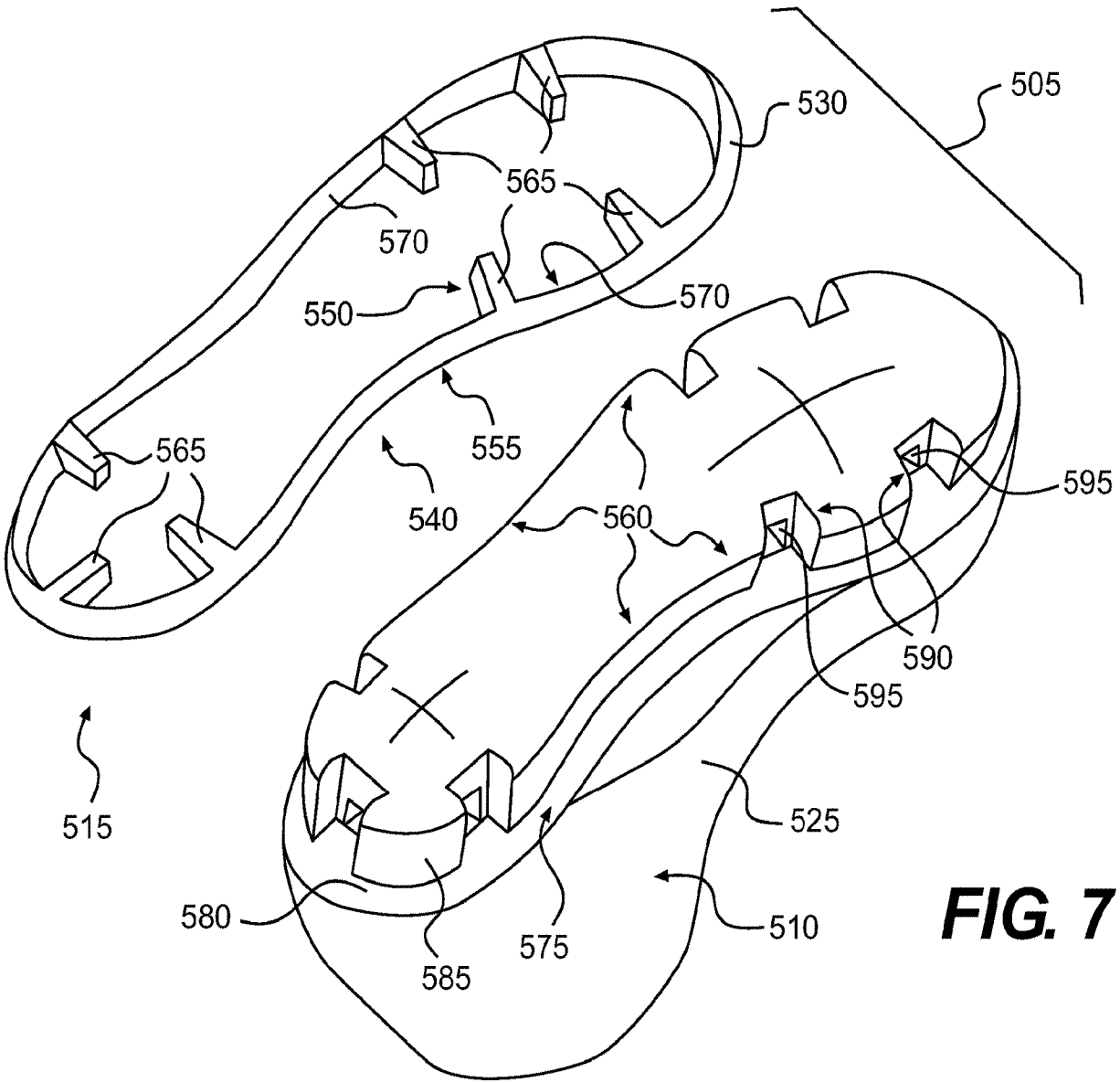
FIG. 7 is an exploded perspective view of an exemplary last including a susceptor component.

FIG. 7 is a perspective, exploded, bottom side view of last 505, showing both first component 525 and susceptor component 515 separately. As can be seen from FIG. 7, susceptor component 515 may reside within a groove 575 of first component 525 of last 505. In this configuration, outer surface 530 of susceptor component 515 may sit flush with outer surface 510 of first component 525 of last 505. Thus, outer surface 530 may form at least a portion of the outer shape of last 505, as discussed above.

Groove 575 may have any suitable shape. As shown in FIG. 7, groove 575 may include an upper surface 580 and an inner surface 585. Groove 575 may also include one or more recesses 590 extending inward to accommodate inner rails 565 of susceptor component 515. In addition, recesses 590 may include holes 595 extending further inward. Recesses 590 may be sized to provide space around inner rails 565 and first component 525 of last 505. Holes 595 may be sized to substantially mate with inner rails 565, and thus may serve as contact points between susceptor component 515 and first component 525 of last 505. In some embodiments, the contact points at holes 595 may be the only contact points between susceptor component 515 and first component 525 of last 505. As illustrated in FIG. 7, these contact points at holes 595 are located at inner portions of last 505. That is, holes 595 are disposed remote from outer surface 510 of first component 525 and, when last 505 is fully assembled, holes 595 are located remote from outer surface 530 of susceptor component 515.

The connection between inner rails 565 of susceptor component 515 and holes 595 may be made using any suitable attachment mechanism. Susceptor component 515 may be attached to first component 525 with a press-fit, adhesive, fasteners, or any other suitable fixation method. One or both of first component 525 and susceptor component 515 may be formed in multiple pieces in order to facilitate assembly of the two components.

Figure 8:
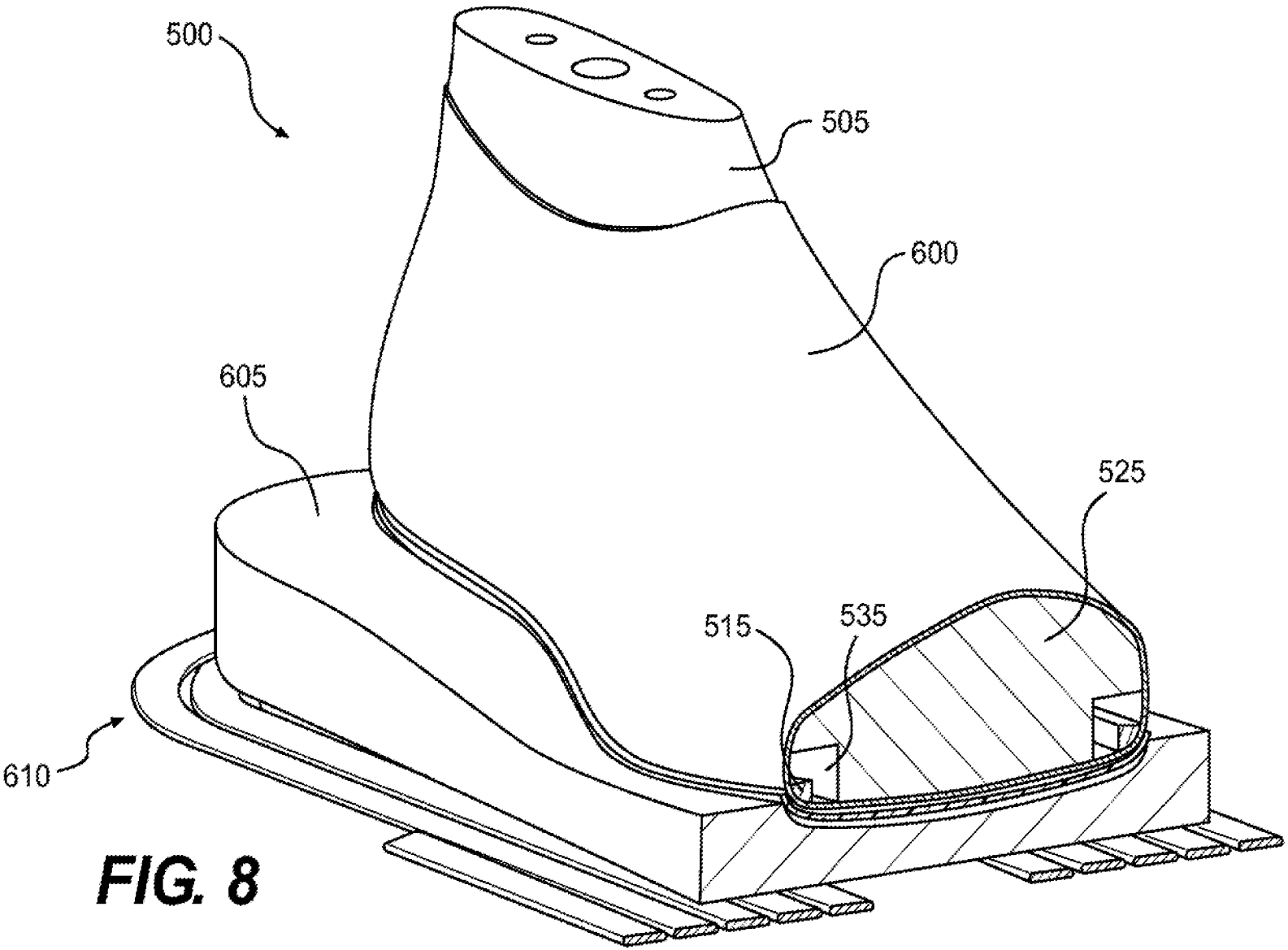
FIG. 8 is a cutaway perspective view of an apparatus for making an article of footwear assembled for executing a heating process.
Figure 9:
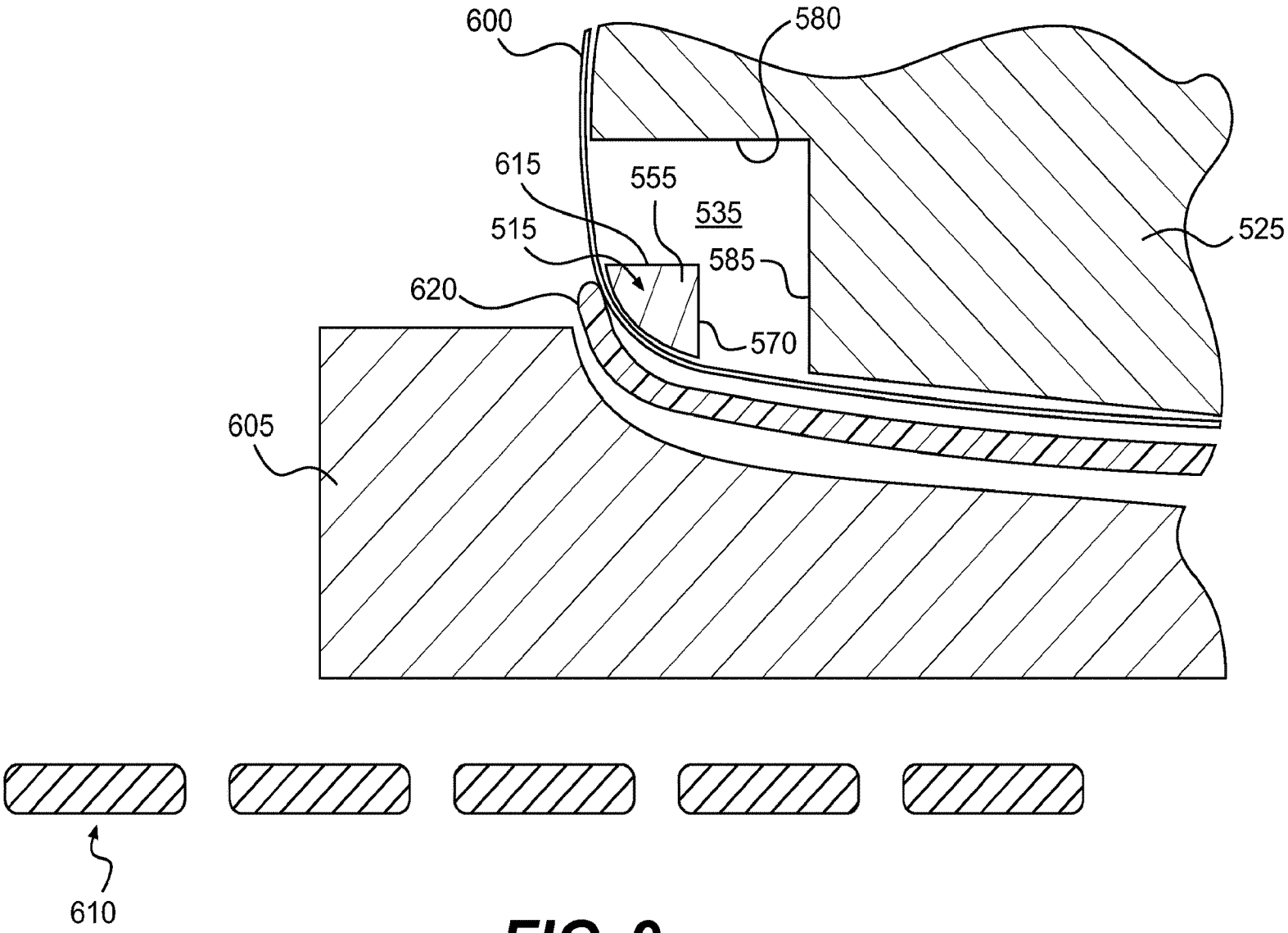
FIG. 9 is a partial cross-sectional view of an apparatus for making an article of footwear assembled for executing a heating process.

FIGS. 8 and 9 are views of apparatus 500 arranged for joining and/or molding of footwear components using induction heating. FIG. 8 is a perspective, partial cross-sectional view of apparatus 500. As illustrated in FIG. 8, an upper 600 may be mounted on and covering at least a portion of last 505. As also illustrated in FIG. 8, apparatus 500 may also include a support block 605 and an induction coil 610. Support block 605 and induction coil 610 may be configured as discussed above regarding support blocks and induction coils.

FIG. 9 is an enlarged view of the cutaway, cross-sectional portion of FIG. 8. As shown in FIG. 9, in some embodiments, outer rail 555 may have a cross-sectional shape that is substantially pie-shaped. For example, outer surface 530 of outer rail 555 may be curved. In addition, outer rail 555 may have a substantially horizontal top surface 615, and inner surface 570 may be substantially vertical. As shown in FIG. 9, in some embodiments, last 505 may be configured to have gap 535 between outer rail 555 and first component 525 of last 505, as described above.

As also illustrated in FIG. 9, apparatus 500 may be configured to join a midsole component, such as a support plate 620, with other footwear components, such as upper 600. Alternatively, or additionally, apparatus 500 may be configured to mold support plate 620 to have a predetermined shape. The joining and/or molding of support plate 620 may be accomplished using heat produced with induction heating. For example, susceptor component 515 may be heated with induction in response to an electromagnetic field produced by induction coil 610. Susceptor component 515 may transfer at least some of the heat conductively to upper 600 and/or support plate 620. The processes of joining and molding footwear components using induction heating with apparatuses such as apparatus 500 are discussed in greater detail below.

Figure 10:
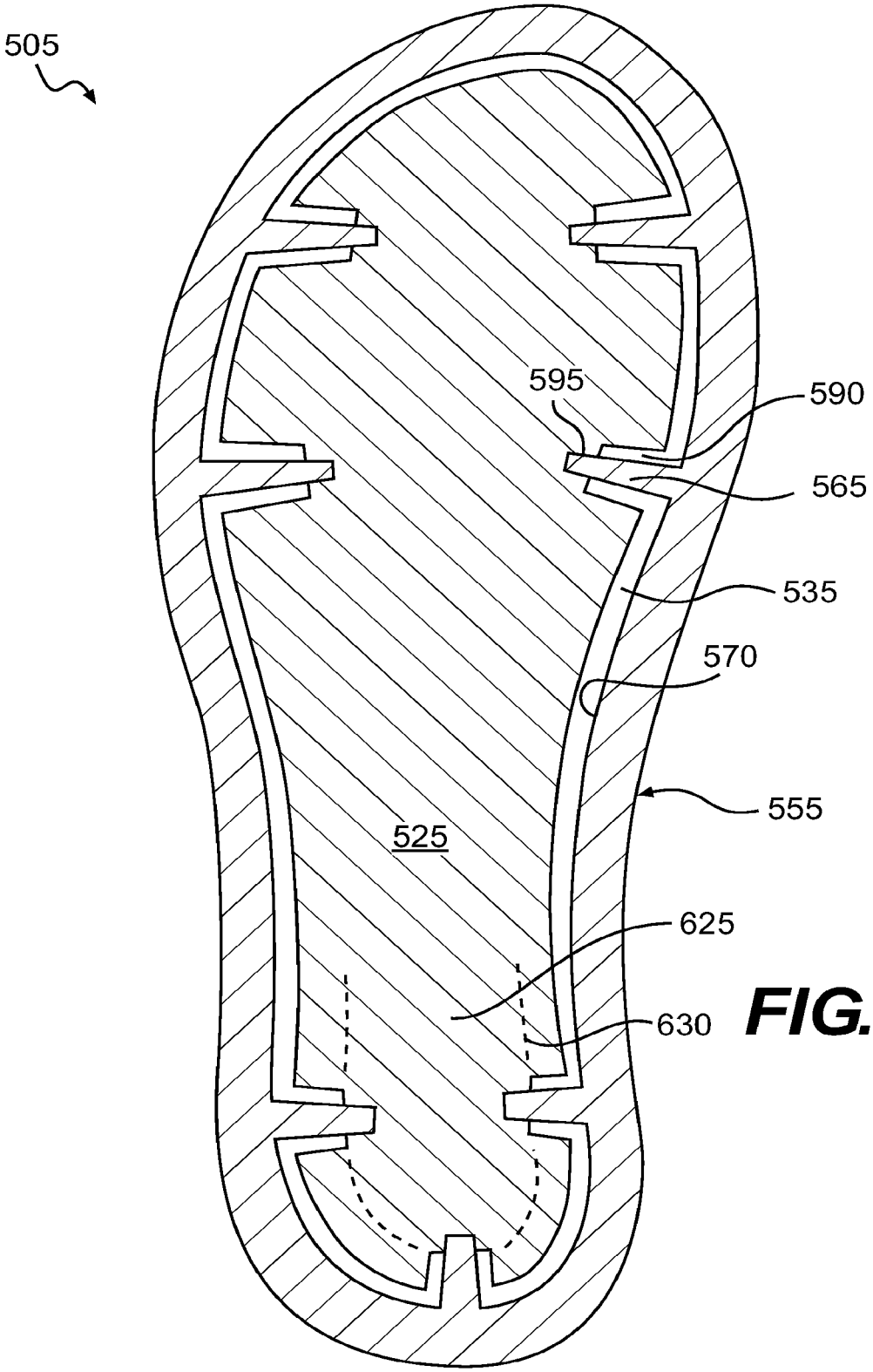
FIG. 10 is a cross-sectional view of an exemplary last including a susceptor component.

FIG. 10 is a cross section taken in the direction of line 10 depicted in FIG. 2. It will be noted that, as illustrated in the accompanying figures, in some embodiments, outer rail 555 of susceptor component is not planar. Rather, outer rail 555 may have vertical contours, such as a raised region corresponding with the arch of the foot, and a heel region that sits higher than the forefoot region. However, for purposes of illustration, the cross-sectional view shown in FIG. 10 depicts the cross section of last 505 taken through a vertical center portion of outer rail 555. Thus, the cross-section of last 505 has been reduced to a two-dimensional representation following the vertical contours of outer rail 555 of susceptor component 515.

FIG. 10 illustrates the connection between susceptor component 515 and first component 525 of last 505. FIG. 10 shows inner rails 565 disposed within recesses 590 and holes 595. FIG. 10 also shoes inner rails 565 extending from inner surface 570 of outer rail 555, in an inward direction. As discussed above, in some embodiments, only the inner portion of the susceptor component may contact the first component of the last. Outer portions of the susceptor component and the first component of the last may remain isolated and independent of one another. That is, the inner portions of susceptor component 515 may contact first component 525 of last 505 at an interior portion 625 of the first component of the last. A dashed line 630 delineates, approximately, a boundary of the portion of first component 525 referred to herein as inner portion 625.

Figure 11:
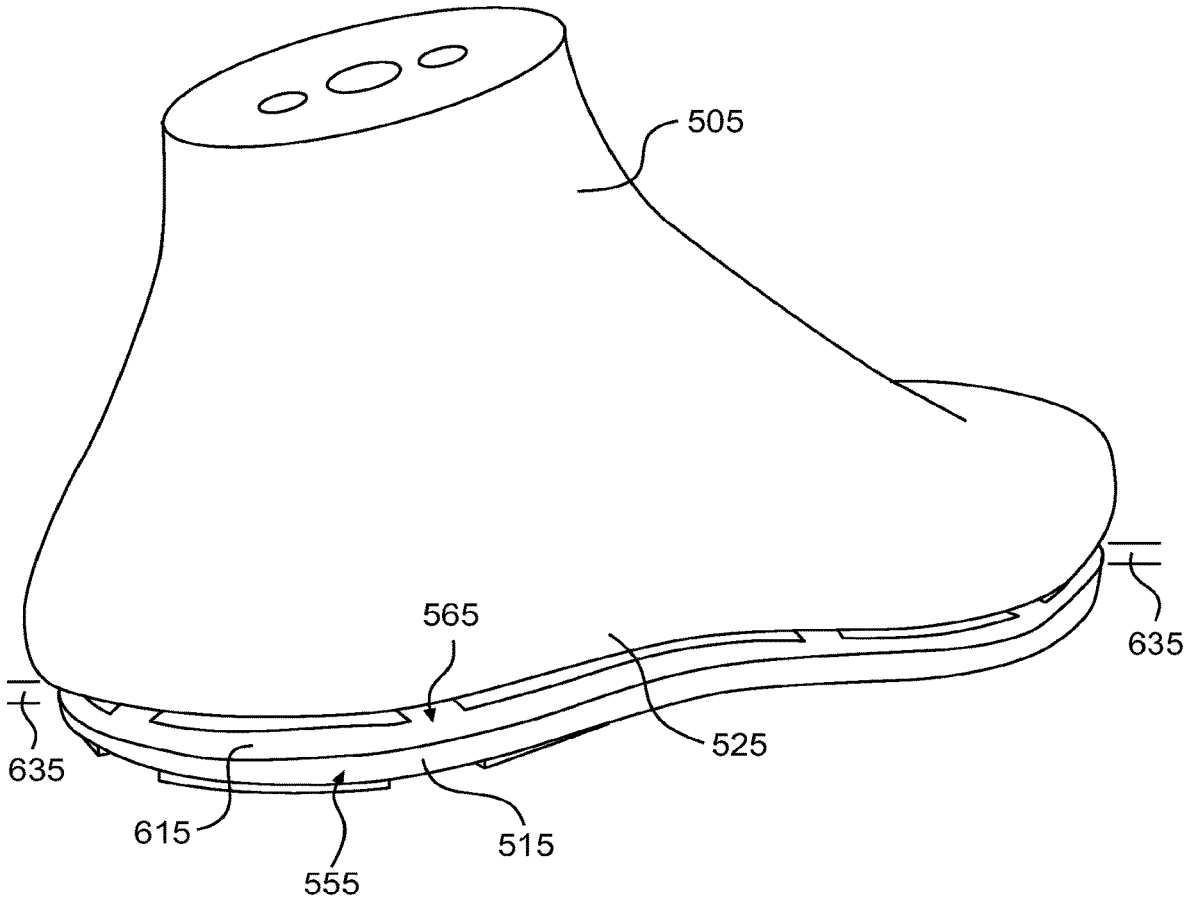
FIG. 11 is a perspective view of an exemplary last including a susceptor component.

FIG. 11 illustrates the spacing between top surface 615 of outer rail 555 and first component 525 of last 505. As shown in FIG. 11, may be separated from first component 525 of last 505 by a continuous gap 635 about a periphery of last 505.

In some embodiments, rather than having a gap between the susceptor component and the rest of the last, a thermally isolative filler material may be disposed between the susceptor and the rest of the last, in order to thermally isolate the susceptor, so that heating may be targeted. The filler material may be a non-inductive, non-conductive material so that it does not increase in temperature when exposed to electromagnetic radiation. The material may also be thermally non-conductive, in order to keep heat from the susceptor component from conducting to the rest of the last.

Figure 34:
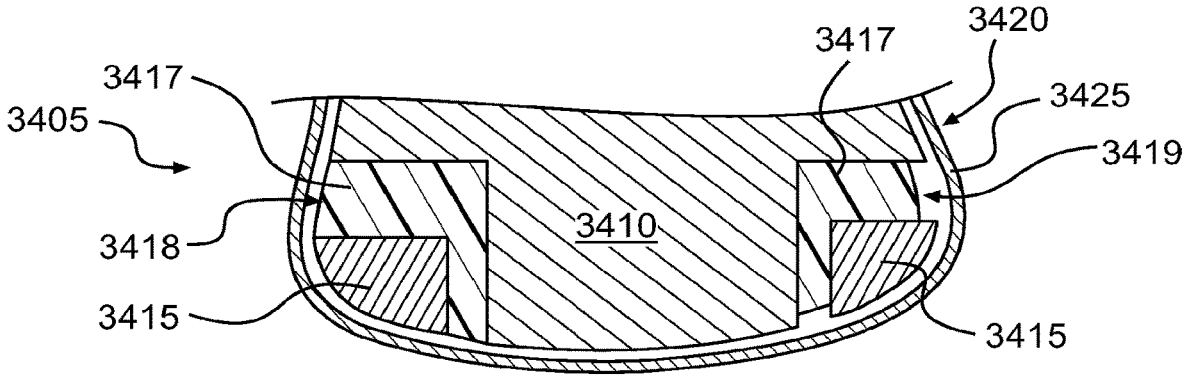
FIG. 34 is a cross-sectional view of an exemplary last including a susceptor component.

FIG. 34 illustrates an exemplary embodiment including a filler material between the susceptor component and the rest of the last. FIG. 34 shows a cross-sectional view of a last 3405 shaped to resemble a human foot. In some embodiments, last 3405 may include a first component 3410, which may be formed of non-susceptor materials. Last 3405 may also include a susceptor component 3415 formed, at least in part, of a susceptors material. In addition, last 3405 may also include a filler material 3417 disposed between susceptor component 3415 and first component 3410 of last 3405. Filler material 3417 may be a non-susceptor material, and thus, may be electrically non-conductive. In addition, filler material 3417 may be a thermally non-conductive material. Exemplary such filler materials may include ceramics, silicone, or any other suitable material having these properties.

In some embodiments, an outer surface of filler material 3417 may be flush with the outer surface of first component 3410 of last 3405 and/or susceptor component 3415. For example, the left side of FIG. 34 illustrates a flush outer surface 3418 of filler material 3417. In some embodiments, the outer surface of filler material 3417 may be recessed from the outer surface of first component 3410 of last 3405 and/or susceptor component 3415. For example, the right side of FIG. 34 illustrates a recessed outer surface 3419 of filler material 3417.

A method of using apparatus 3400 may include covering last 3405, at least in part, with one or more footwear components 3420 of an article of footwear. For example, as shown in FIG. 34, an upper 3425 may be mounted on last 3405. Last 3405 may be utilized to apply heat to upper 3425 during a footwear manufacturing process, such as molding or joining of footwear components. Exemplary such processes are discussed in more detail below. During such processes, filler material 3417 may isolate first component 3410 of last 3405 from susceptor component 3415, in order to prevent undue amounts of heat from being transferred to first component 3410 from susceptor component 3415.

Manufacturing Processes—Susceptor in Last

Processes for making articles of footwear using induction heating and implementing manufacturing apparatuses, such as those described above will be discussed below.

Induction heating may be implemented in various ways using susceptor materials disposed in the last of a footwear manufacturing apparatus. An electromagnetic field may inductively heat the susceptor material in the last, and the susceptor material may conductively transfer heat to one or more footwear components mounted on the last. This inductive heating and associated transfer to footwear components may be used to join footwear components together and/or to mold footwear components. The following discussion describes exemplary methods of joining and/or molding footwear components using the induction heating of susceptor materials in a last.

A. Joining

Figure 12:
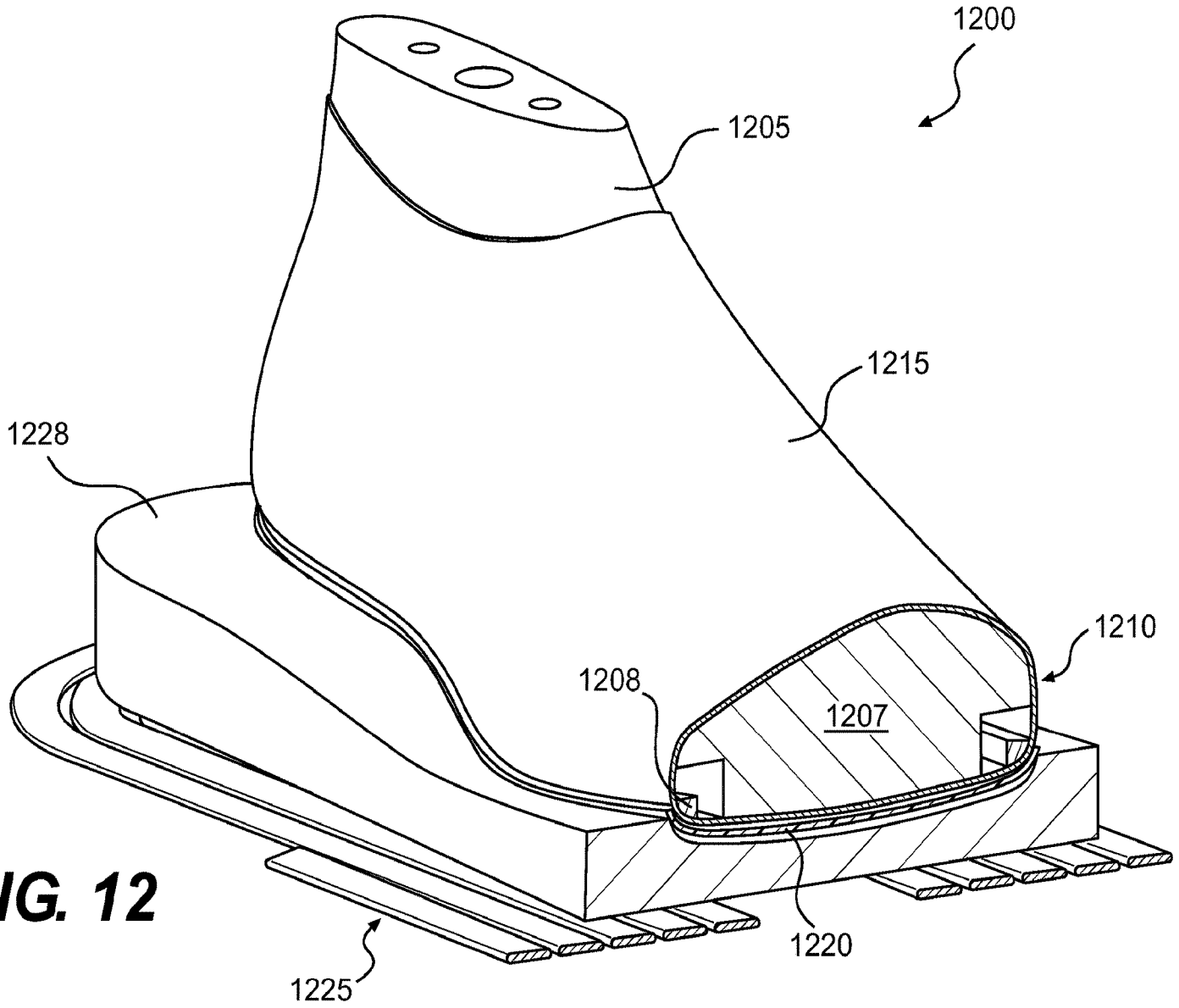
FIG. 12 is a cutaway perspective view of an apparatus for making an article of footwear assembled for executing a heating process.

An exemplary apparatus 1200 for making an article of footwear is depicted in FIG. 12. Apparatus 1200 may be implemented to execute an induction heating method for joining footwear components. The method may include providing a last 1205 shaped to resemble a human foot and formed at least in part from a first component 1207 a susceptor material that is thermally reactive to an electromagnetic field. In some embodiments, the susceptor material may be incorporated in a susceptor component 1208, as shown in FIG. 12. The method may also include covering last 1205 at least in part with one or more footwear components 1210 (for example an upper 1215 and a support plate 1220) of an article of footwear. In addition, the method may include placing the susceptor material in proximity with the one or more footwear components covering last 1205. The footwear components may be placed in proximity with the susceptor material using a support block 1228. Once the footwear components are in place, the next step involves placing the assembly (last 1205 with the footwear components mounted on last 1205 and/or held against it) in proximity with an induction coil 1225.

Figure 13:
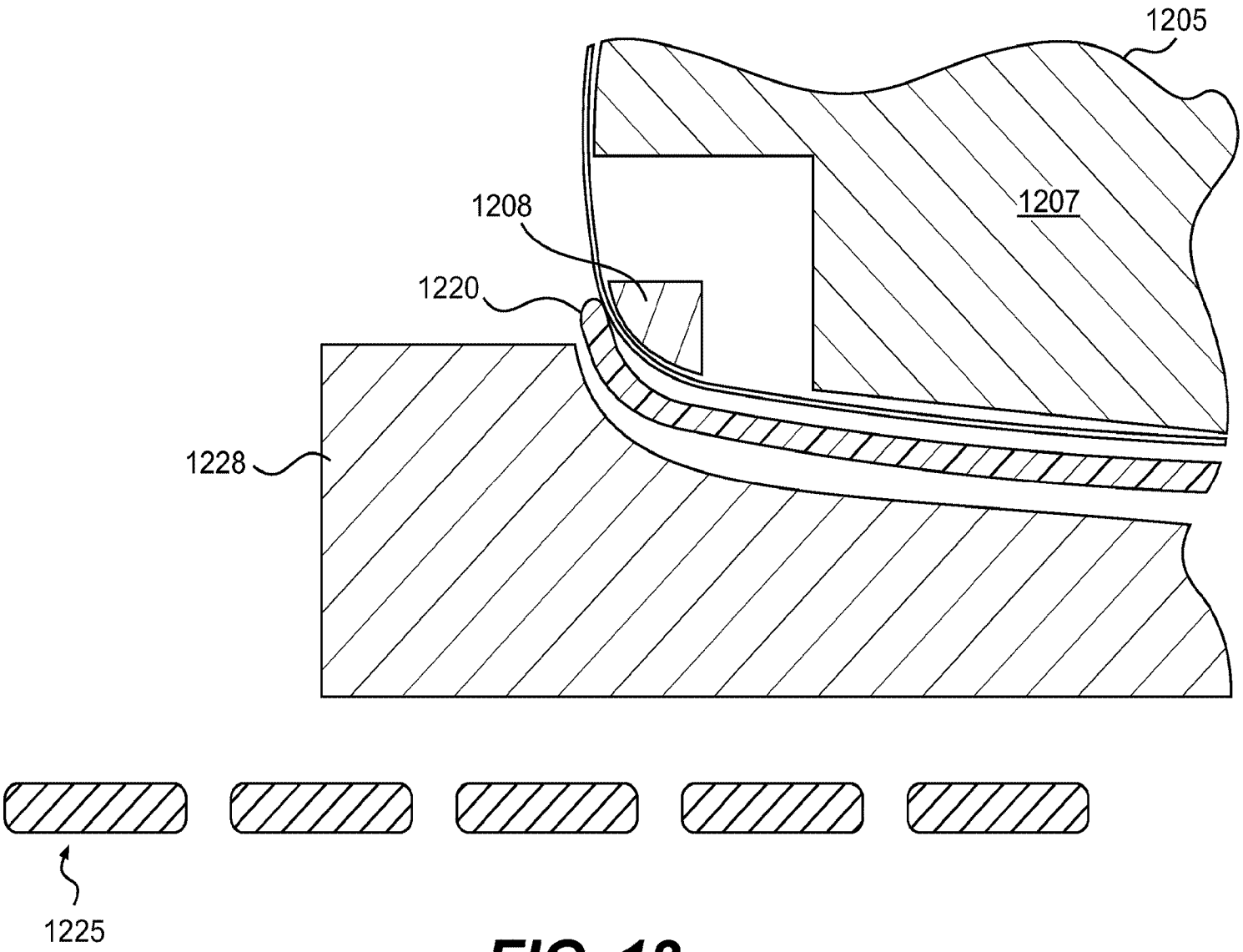
FIG. 13 is a partial cross-sectional view of an apparatus for making an article of footwear assembled for executing a heating process.

The method also involves increasing the temperature of the susceptor material by induction heating by producing an electromagnetic field using induction coil 1225 and transferring heat from the susceptor material to the one or more footwear components covering last 1205. FIG. 13 is an enlarged view of the partial cross-sectional portion of FIG. 12. As shown in FIG. 13, one of the at least two footwear components may be a component of a midsole of the article of footwear, such as support plate 1220. Further, one of the at least two footwear components may be a panel of upper 1215. The method may include joining of the at least two footwear components, for example, the support plate 1220 and upper 1215. Joining of the two footwear components may include fixedly attaching support plate 1220 to upper 1215.

The joining of footwear components, such as support plate 1220 and upper 1215, for example, may be caused by the transfer of heat to the footwear components. For example, in some embodiments, upon heating of the footwear components, one or both of the footwear components may melt at least partially, resulting in melding of the two components together. In some embodiments, the method may include placing a thermally activated adhesive in contact with the footwear components. In such embodiments, joining of the footwear components may include adhesively bonding portions of the footwear components together by activating the adhesive with heat transferred from the susceptor material to the adhesive.

Figure 14:
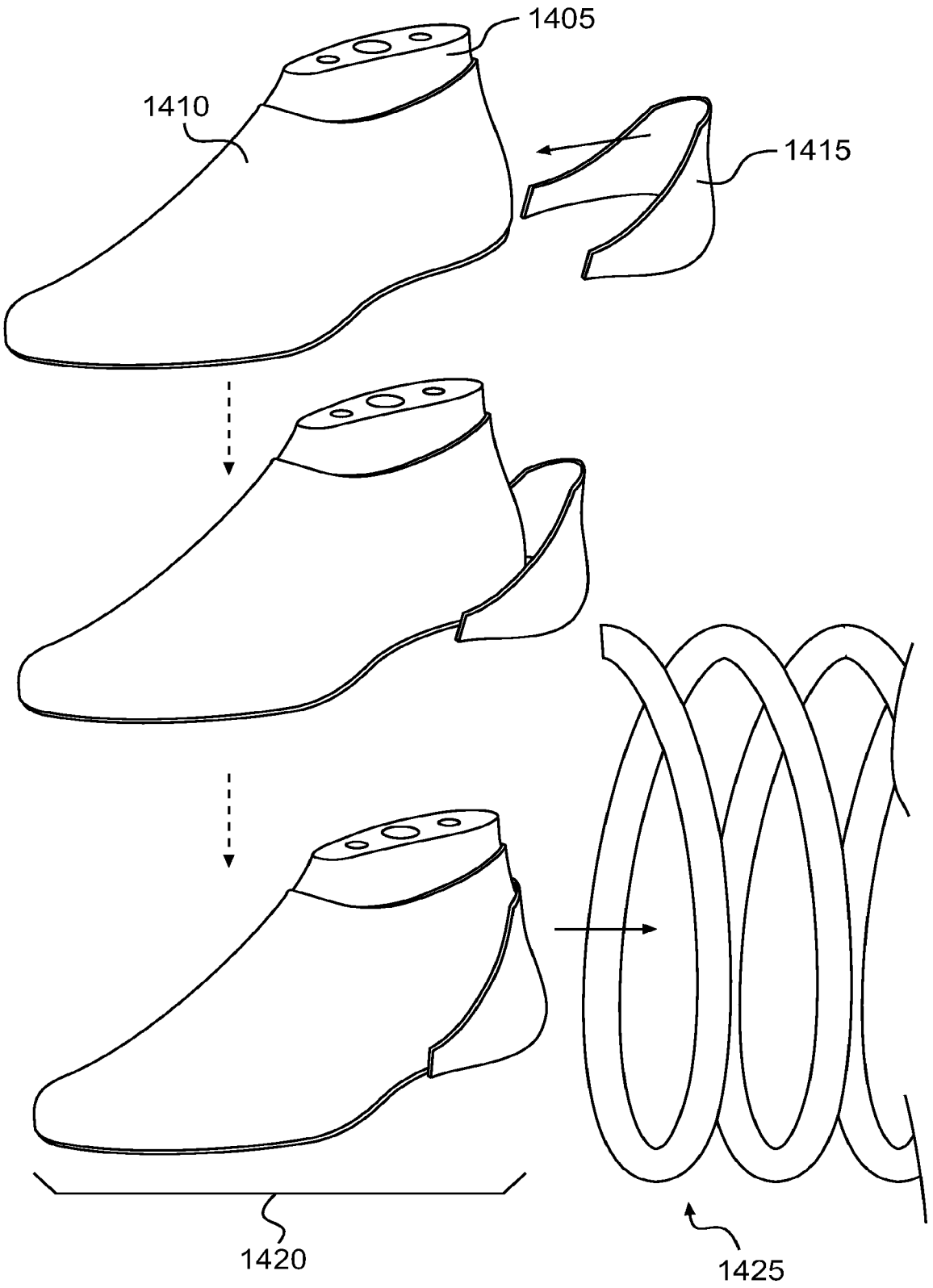
FIG. 14 is a schematic illustration of an exemplary method of joining a heel counter to an upper of an article of footwear.

FIG. 14 illustrates a method of joining a different type of footwear component with an upper. For example, FIG. 14 depicts a last 1405 with an upper 1410 covering at least a portion of last 1405. As shown in FIG. 14, a heel counter 1415 may be brought into contact with upper 1410 in a heel region of last 1405. Heel counter 1415 may be supported and/or pressed against last 1405 by a support block or other such device (not shown). Once heel counter 1415 is in place, last 1405, upper 1410, heel counter 1415, and a support block (not shown) may form an assembly 1420. Assembly 1420 may be placed in proximity to an induction coil 1425. In some embodiments, induction coil 1425 may be tubular, as shown in FIG. 14. However, other types of induction coils may be used, such as planar induction coils, as discussed above.

It is noted that the selection of the type of induction coil may be made with consideration of the location of the footwear components that are desired to be heated. For example, attachment of a midsole support plate is discussed above in conjunction with a planar induction coil. Use of a planar induction coil may be suitable for such an application because the location of the area to be heated is on the bottom portion of the assembly. For assembly 1420, however, the location of the area to be heated falls on three sides of the footwear (lateral, rear, and medial). Therefore, it may be advantageous to use a tubular coil, which may be placed around assembly 1420 in order to more effectively heat the areas of interest. It should also be noted that the induction coil may be oriented in other directions. For example, while a horizontally oriented induction coil 1425 is shown in FIG. 14, it may be desirable to orient the induction coil vertically, or in any other suitable orientation. Further, in some embodiments, the induction coil may be moved into place for application of the electromagnetic field. In some embodiments, assembly 1420 may be moved into position within induction coil 1425. In still other embodiments, both assembly 1420 and induction coil 1425 may be moved.

Placement of susceptor components may be selected according to the location of the footwear components desired to be heated. For example, sole structure components, like a support plate, were discussed above. For such footwear components, it may be desirable to implement susceptor components at a bottom portion of the last. However, when the target footwear components are not desired to be joined to a bottom portion of the article of footwear, it may be suitable to locate the susceptor component in an alternative location that coincides with the desired location at which the footwear component is to be attached to the upper. For example, regarding the attachment of a heel counter, as described above, it may be desirable to locate the susceptor component in a heel region of the last. Similarly, susceptor components may be located in other parts of the last, such as the toe region, for use heating footwear components corresponding with the toe region of the article of footwear.

Figure 15:
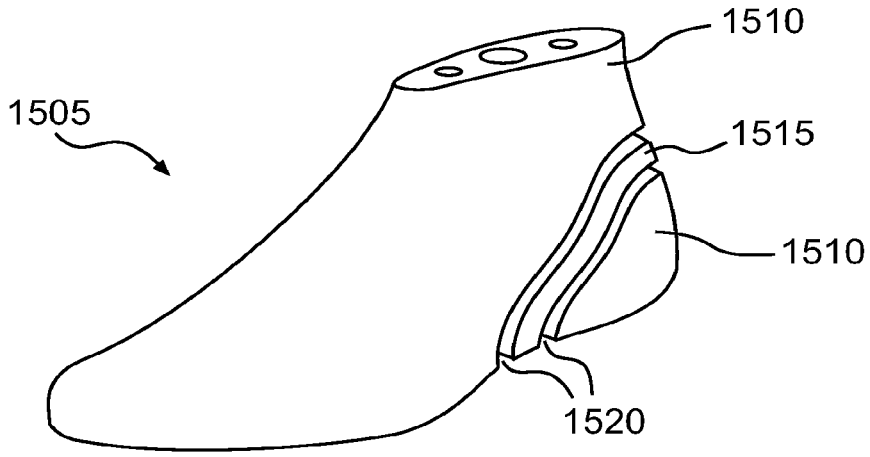
FIG. 15 is a perspective view of an exemplary last including a susceptor component.

FIG. 15 illustrates an alternative embodiment of a last. As shown in FIG. 15, a last 1505 may be configured to provide heating to a heel region of last 1505. Last 1505 may include a first component 1510, which may be formed of non-susceptor materials. In addition, last 1505 may include a susceptor component 1515 formed, at least in part, from material that is thermally reactive to an electromagnetic field. As shown in FIG. 15, susceptor component may be disposed in a heel region of last 1505. Further, for reasons discussed above, last 1505 may be configured with gaps 1520 between susceptor component 1515 and first component 1510 of last 1505 in outer regions of last 1505. In some embodiments, susceptor component 1515 may be suited for joining a heel counter component to an upper. Accordingly, susceptor component 1515 may be shaped to correspond with an outer border of the heel counter. In FIG. 15, susceptor component 1515 is shown with a curved shape. This may correspond with heel counters having similar curved shapes.

Figure 16:
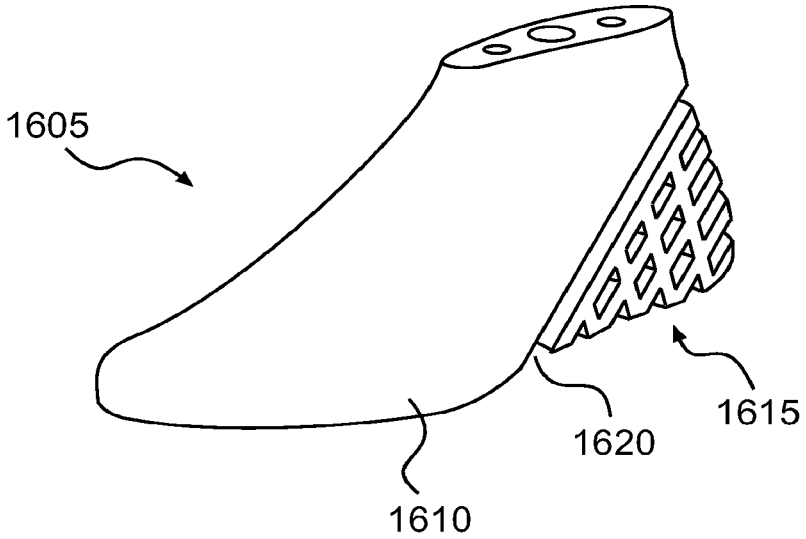
FIG. 16 is a perspective view of an exemplary last including a susceptor component.

FIG. 16 illustrates an alternative configuration for a heel-region susceptor component. In some embodiments, it may be desirable to join components only at the outer periphery of the components. In other embodiments, it may be desirable to join the components over a larger contacting surface area between the two components. In such embodiments, a susceptor component may have a larger, solid surface area. In other embodiments, as shown in FIG. 16, a last 1605 may include a first component 1610, formed of non-susceptor materials, and a susceptor component 1615 formed of a patterned structure. For example, as shown in FIG. 16, susceptor component 1615 may include a grid or waffle-type pattern. In addition, for reasons discussed above, last 1605 may have a gap 1620 between susceptor component 1615 and first component 1610 of last 1605.

There may be several advantages of using a susceptor component having the form of a grid instead of a solid susceptor component. For example, a grid can provide broad area surface heating similar to a solid susceptor component, but can do so using less of susceptor material. This may be desirable, since susceptor materials may be expensive and/or heavy. Using a grid or other type of pattern can reduce weight, distribute heat evenly, control heat transfer, and cover large area. In some embodiments, a grid or other patterned susceptor component may be used to provide a less extensive and, therefore, less permanent attachment. For some types of footwear, it may be desirable for components to be able to be pulled apart with some effort. For example, it is common to resole dress shoes. Resoling would not be possible, however, if a heel of a shoe were permanently attached to the upper and/or other sole structure components. Therefore, it would be advantageous to have a broad surface heating component that may effectuate joining of components at intermittent locations, rather than forming one solid melding of the surfaces of both components, in order to produce footwear with replaceable components. A grid or other patterned susceptor component may be suitable for such applications.

Figure 17:
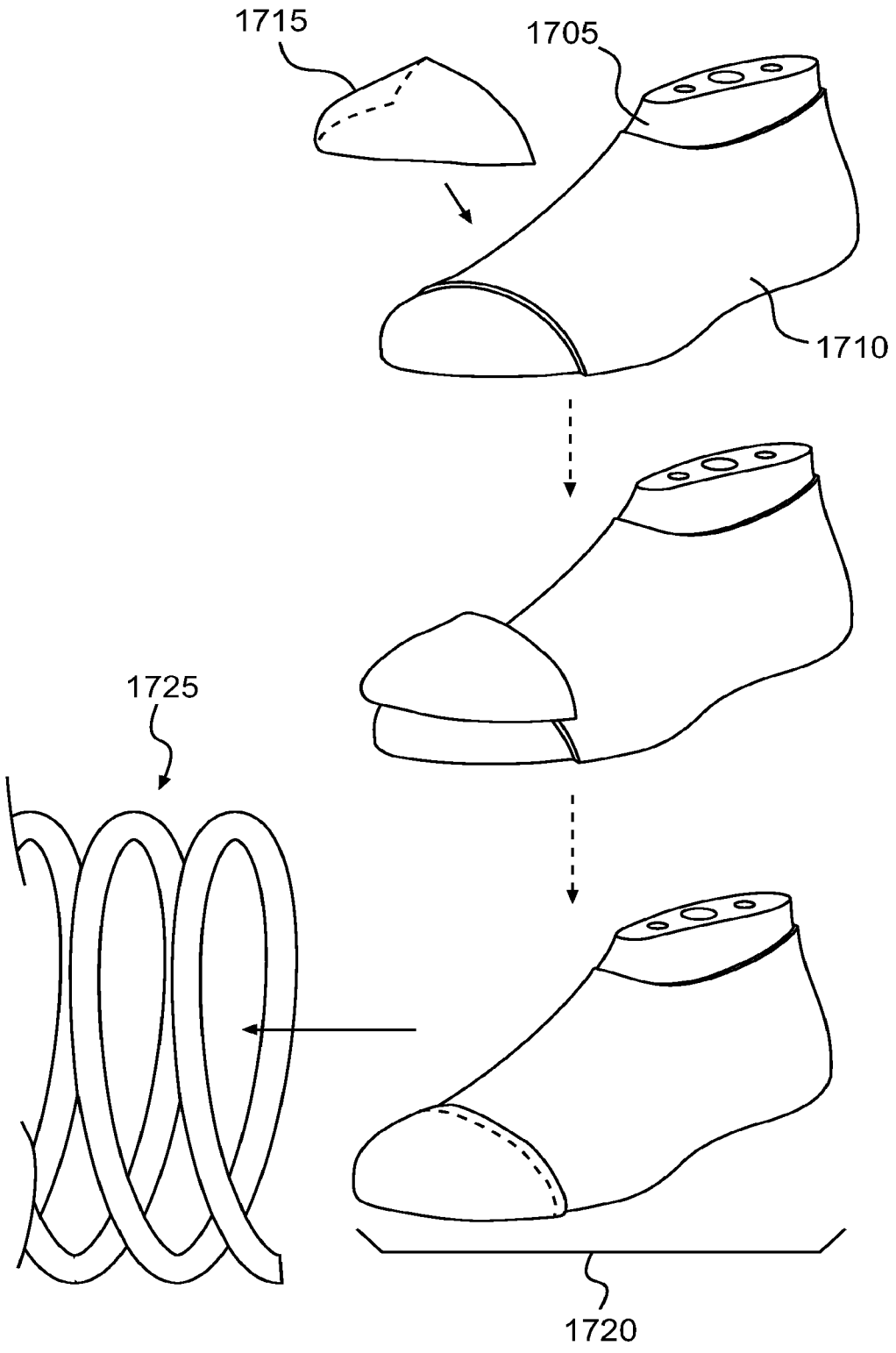
FIG. 17 is a schematic illustration of an exemplary method of joining a toe cap to an upper of an article of footwear.

FIG. 17 illustrates an exemplary method which may involve use of a last 1705 in the joining of an upper panel 1710 with a toe cap 1715. It should be noted that, as shown in FIG. 17, toe cap 1715 is not a covering over an upper panel, but rather, is a panel of an upper itself. However, such a joining method may be carried out to join a cover-type toe cap in a similar manner.

Toe cap 1715 may be brought into contact and held with pressure against last 1705 using, for example, a support block (not shown) in a similar manner to that described above with regard to heel counter 1415. With toe cap 1715 in place, last 1705, upper panel 1710, toe cap 1715, and the support block or similar device may form an assembly 1720. As shown in FIG. 17, upper panel 1710 and toe cap 1715 may be joined using an induction coil 1725. Assembly 1720 may be exposed to an electromagnetic field produced by induction coil 1725. Assembly 1720 and induction coil 1725 may be maneuvered with respect to one another in a similar fashion to assembly 1420 and induction coil 1425 discussed above.

Figure 18:
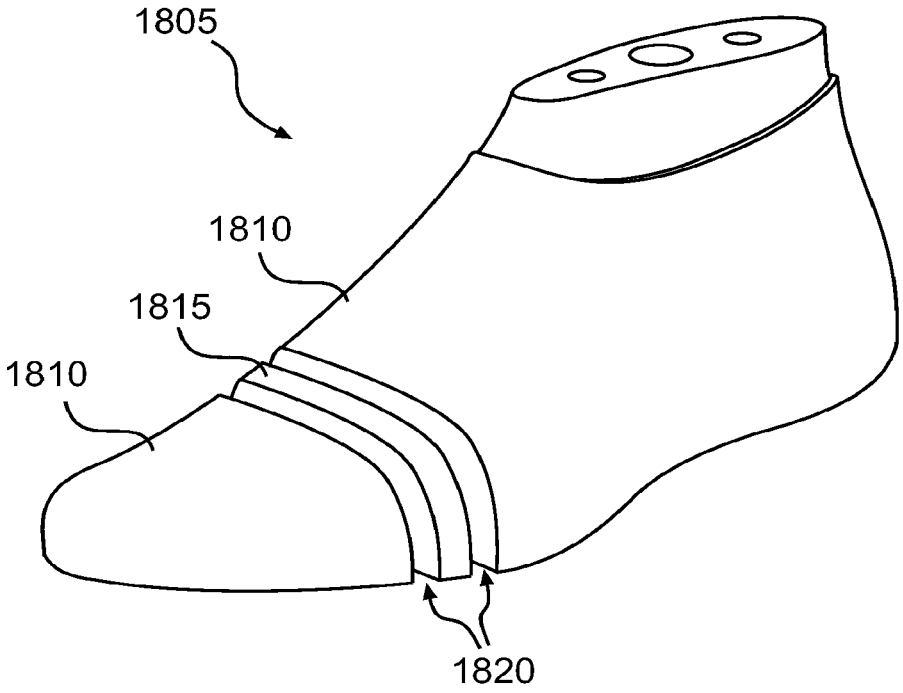
FIG. 18 is a perspective view of an exemplary last including a susceptor component.

FIG. 18 illustrates an alternative placement of a susceptor component, suitable, for example, for applying heat to a footwear component covering a toe region of a last, such as a toe cap or toe cap panel of an upper. As shown in FIG. 18, a last 1805 may include a first component 1810, formed of non-susceptor materials. Last 1805 may also include a susceptor component 1815. As shown in FIG. 18, susceptor component 1815 may be disposed in a toe region of last 1805. In some embodiments, susceptor component 1815 may be disposed in a location that corresponds with an adjoining boundary or overlapping region between a toe cap panel and a remaining panel of the upper. In addition, for reasons discussed above, last 1805 may be configured with gaps 1820 between susceptor component 1815 and first component 1810 of last 1805. For example, gaps 1820 may enable more precisely targeted heating and/or may preserve the integrity of non-susceptor materials of last 1805 by preventing or limiting undesired heating due to thermal conduction.

Figure 19:
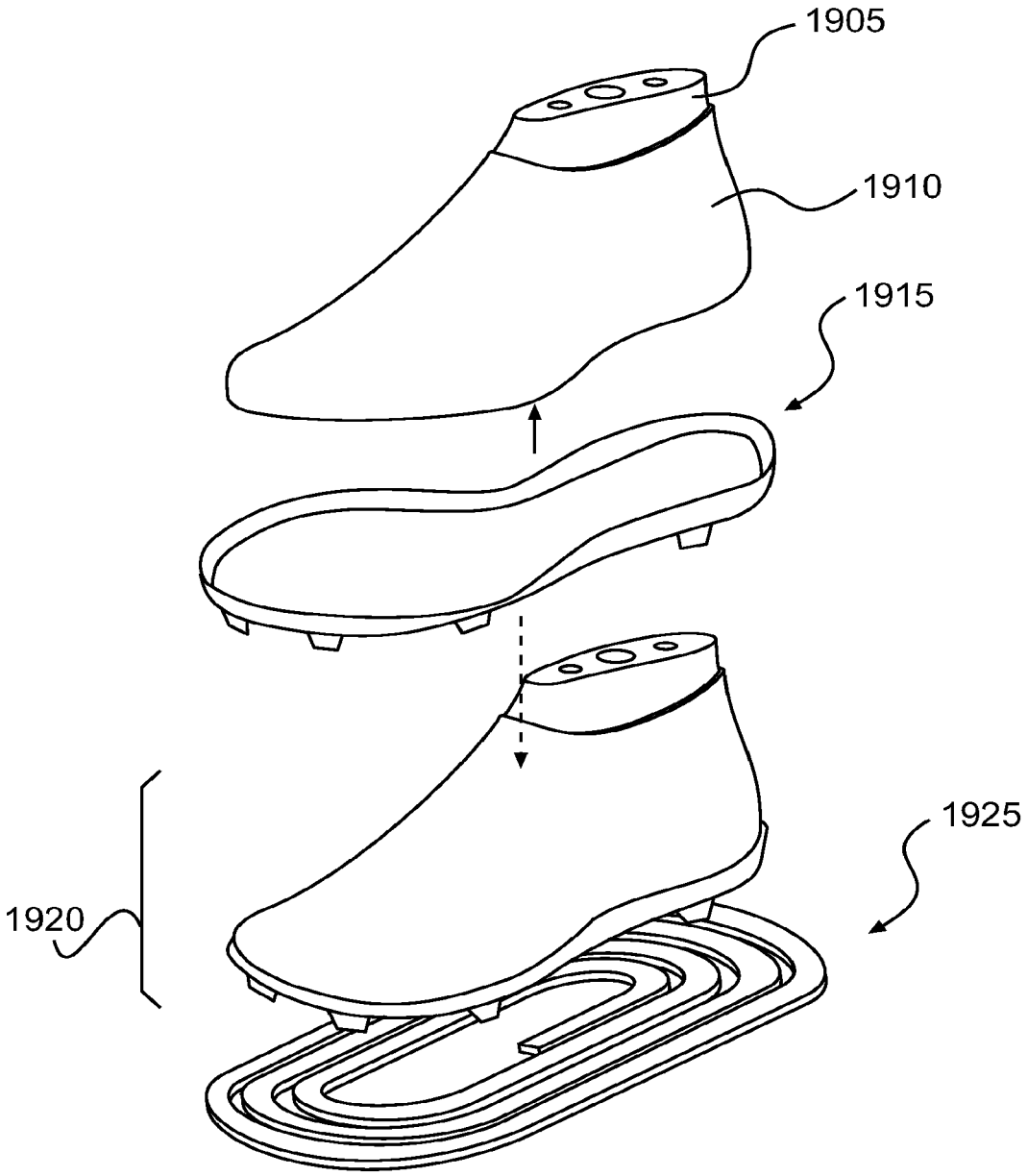
FIG. 19 is a schematic illustration of an exemplary method of joining a sole component to an upper of an article of footwear.

FIG. 19 illustrates an exemplary method of joining a ground-contacting sole component with an upper. FIG. 19 shows a last 1905 having an upper 1910 mounted on the last. Last 1905 may be formed, at least in part, of a susceptor material that is thermally responsive to an electromagnetic field to undergo induction heating. Exemplary suitable susceptor materials and components may be selected according to the description above. FIG. 19 also shows a ground-contacting sole component 1915. Sole component 1915 is depicted as a cleated sole, suitable for outdoor sports, such as soccer, baseball, football, and other sports. However, the method illustrated in FIG. 19 of joining a sole component with an upper of an article of footwear may be used to join any type of sole with an upper or other footwear components.

Once sole component 1915 is held in place (for example by a support block (not shown)), last 1905, upper 1910, sole component 1915 and, in some embodiments, a support block may form an assembly 1920. The process of joining sole component 1915 to upper 1910 may include fixedly attaching the sole component to the panel of the upper using heat generated by induction heating. For example, assembly 1920 may be exposed to an electromagnetic field produced by an induction coil 1925.

As shown in FIG. 19, induction coil 1925 may be a planar-type coil. In other embodiments, induction coil 1920 may have an alternative shape, such as a tubular coil. In addition, assembly 1920 and induction coil 1925 may be maneuvered with respect to one another in a similar fashion to assembly 1420 and induction coil 1425 discussed above.

Upon exposure to an electromagnetic field, the susceptor material in last 1905 may increase in temperature due to induction heating. Some of the heat produced in last 1905 may be conductively transmitted to upper 1910 and sole component 1915. The transferred heat may cause upper 1910, sole component 1915, or both to melt, resulting in the two components becoming fixedly attached by melding together.

B. Molding

A method of making an article of footwear may include providing a last 2005 shaped to resemble a human foot and formed at least in part from a susceptor material that is thermally reactive to an electromagnetic field. The method may also include covering the last at least in part with one or more footwear components, such as an upper and a support plate. Further, the method may include placing the susceptor material in proximity with the footwear components covering the last. For example, a support block may be used to hold the support plate against the upper covering the last.

The method may include placing the last in proximity with an induction coil and increasing the temperature of the susceptor material by induction heating by producing an electromagnetic field with the induction coil. Because of the contact between the footwear components and the susceptor material in the last, the method may further include transferring heat from the susceptor material to the footwear components covering the last, for example by thermal conduction. This heating of the footwear components may cause molding of one or more of the footwear components into a predetermined shape.

Figure 20:
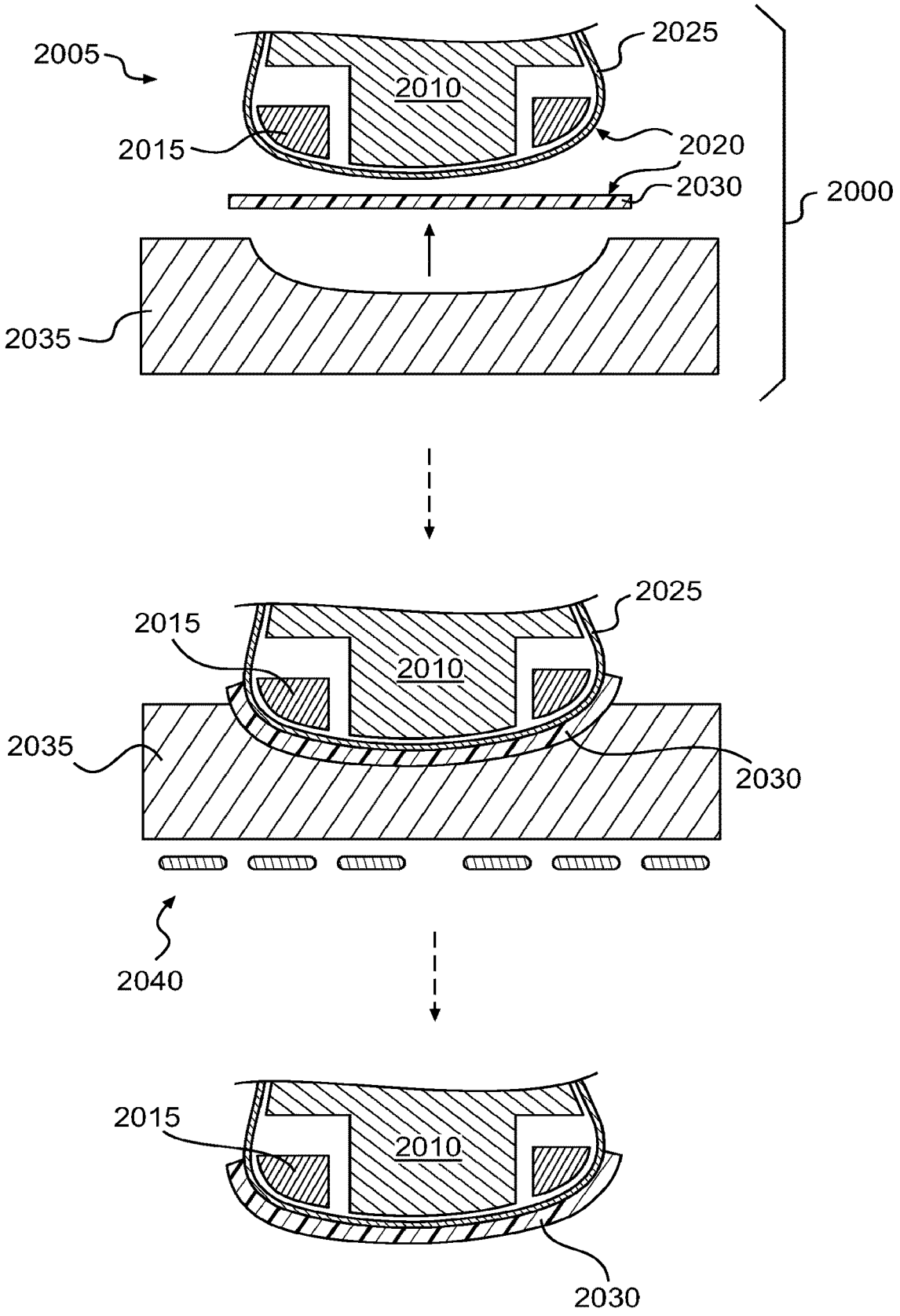
FIG. 20 is a schematic illustration of an exemplary method molding a support plate of an article of footwear.

FIG. 20 depicts an exemplary method of making an article of footwear, including molding of a footwear component using heat produced by induction heating of a susceptor component in a last. FIG. 20 shows cross-sectional views of an apparatus 2000 for making an article of footwear, in various stages of the method. Apparatus 2000 may include a last 2005 shaped to resemble a human foot. In some embodiments, last 2005 may include a first component 2010, which may be formed of non-susceptor materials. Last 2005 may also include a susceptor component 2015 formed, at least in part, of a susceptors material.

The method may include providing last 2005, and covering last 2005 at least in part with one or more footwear components 2020 of an article of footwear. For example, as shown in FIG. 20, an upper 2025 may be mounted on last 2005. The method may also include placing the susceptor material in proximity with the one or more footwear components covering the last. For example, as shown in FIG. 20, a midsole component, such as a support plate 2030 may be brought into contact with upper 2025 on last 2005. In order to facilitate this contact, apparatus 2000 may include a support block 2035 or other similar device to hold support plate 2030 in place. Once support plate 2030 is in place, last 2005, with upper 2025 and support plate 2030 mounted and/or pressed against last 2005, may be placed in proximity with an induction coil 2040.

It will be noted that, in some configurations, support block 2035 may incorporate susceptor component 2015 and/or induction coil 2040. In such configurations, susceptor component 2015 and/or induction coil 2040 may be at least partially embedded in support block 2035. Further, in some configurations, susceptor component 2015 and/or induction coil 2040 may be at least partially located on an outer surface of support block 2035.

The temperature of susceptor component 2015 may be increased by using induction coil 2040 to produce an electromagnetic field, and exposing susceptor component 2015 to the electromagnetic field. Heat may be transferred conductively from susceptor component 2015 to support plate 2030 by thermal conduction between susceptor component 2015, upper 2025, and support plate 2030.

The transferring of heat to support plate 2030 may cause molding of support plate 2030 into a predetermined shape. As shown in FIG. 20, support plate 2030 may initially have a substantially planar shape. During the heating method, support plate 2030 may be held against last 2005, which has a curved shape. While support plate 2030 is held in a curved shape, at least some of the heat inductively generated in susceptor component 2015 may conductively transfer to support plate 2030, causing molding of support plate 2030 into the curved shape. It should be noted that the location of susceptor component 2015 at peripheral edges of the sole portion of last 2005 may provide targeted heating of the peripheral portions of support plate 2030. The targeted heating of the peripheral portions of support plate 2030 may enable the peripheral portions to take the form of the more tightly curved peripheral edges of the sole portion of last 2005.

In addition, although the cross-sectional view shown in FIG. 20 only shows the molding of support plate 2030 to have a curvature in the lateral direction, contouring may be created in any desired direction. Footwear components may be pressed against last 2005 on any side of last 2005. Accordingly, footwear components (such as sole structure components, panels of an upper, heel counter, toe caps, and other footwear components) may be molded to have the outer shape of any portion of last 2005. Therefore, footwear components may be given anatomical shapes by molding using the induction heating processes described in the present disclosure.

It should also be noted that, in some embodiments, the heating process described above with regard to FIG. 20 may not only mold support plate 2030 to have a shape that mates with the anatomical shape of the bottom of last 2005, but also, the heating of support plate 2030 may cause support plate 2030 to become fixedly attached to upper 2025. For example, the heating of support plate 2030 may meld support plate 2030 and upper 2025 together, as described above regarding other embodiments.

Figure 21:
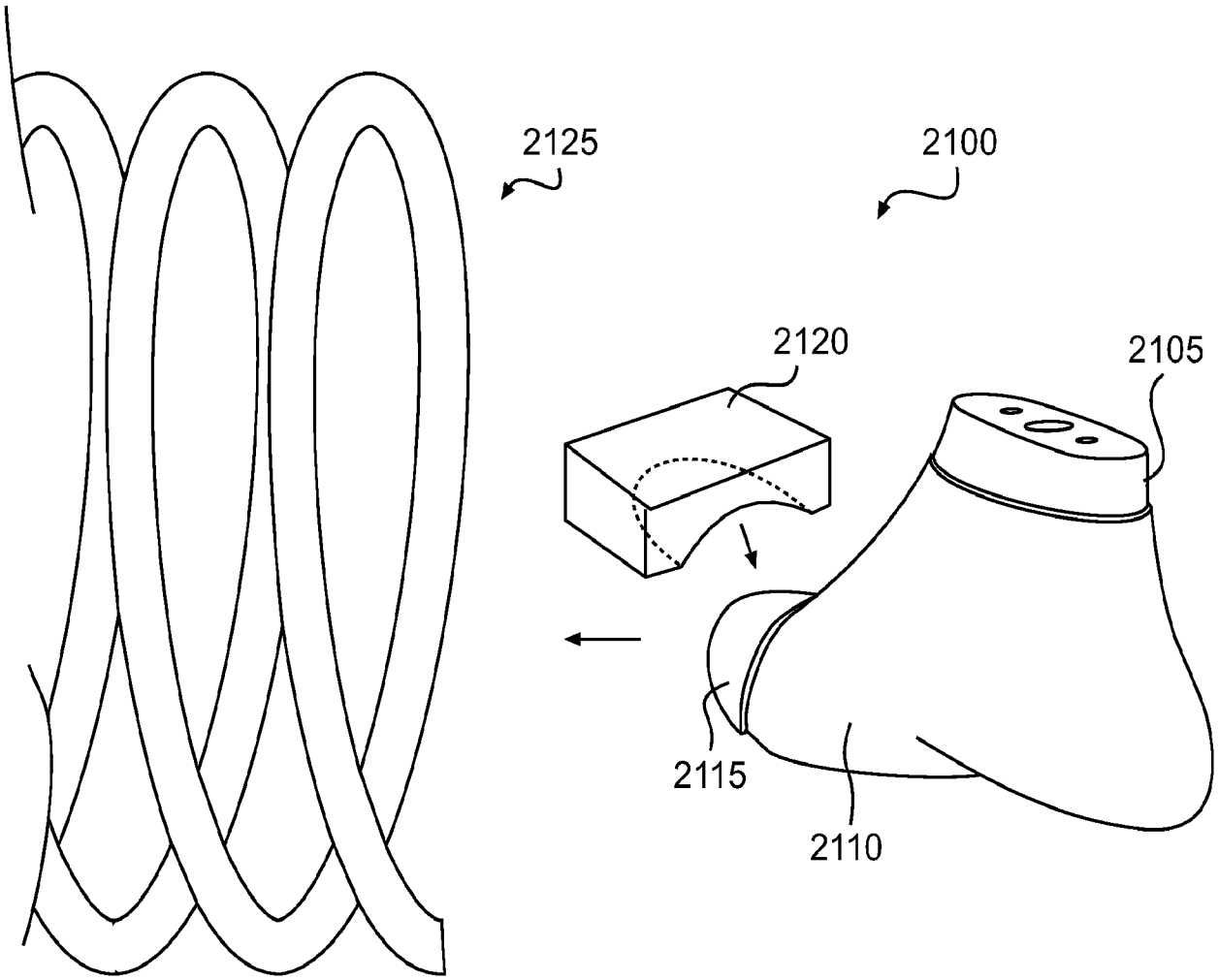
FIG. 21 is a perspective view of an exemplary method molding a toe cap of an article of footwear.

FIG. 21 illustrates a molding process involving a panel of an upper of an article of footwear. As illustrated in FIG. 21, an apparatus 2100 may include a last 2105 shaped to resemble a human foot. Last 2105 may be formed, at least in part, of a susceptor material that is thermally responsive to an electromagnetic field to undergo induction heating. Exemplary suitable susceptor materials and components may be selected according to the description above. An upper 2110 may be mounted on last 2105. In some embodiments, upper 2110 may include multiple panels. For example, as shown in FIG. 21, upper 2110 may include a toe cap 2115 configured to form a portion of upper 2110 in a toe region of the article of footwear. Apparatus 2100 may be used to mold toe cap 2115 into the predetermined shape.

Apparatus 2100 may also include a support block 2120, which may hold toe cap 2115 against last 2105 and may serve as a mold form. The inner shape of toe cap 2115 may be determined by the shape of underlying last 2105. The outer shape of toe cap 2115 may be determined by the shape of support block 2120.

Apparatus 2100 may further include an induction coil 2125. Once assembled, last 2105, upper 2110, toe cap 2115, and support block 2120 may be exposed to an electromagnetic field produced by induction coil 2125. In response, the susceptor material in last 2105 may undergo induction heating. At least some of the heat produced in the susceptor material may be transferred conductively to toe cap 2115, causing toe cap 2115 to mold into a predetermined shape.

Figure 22:
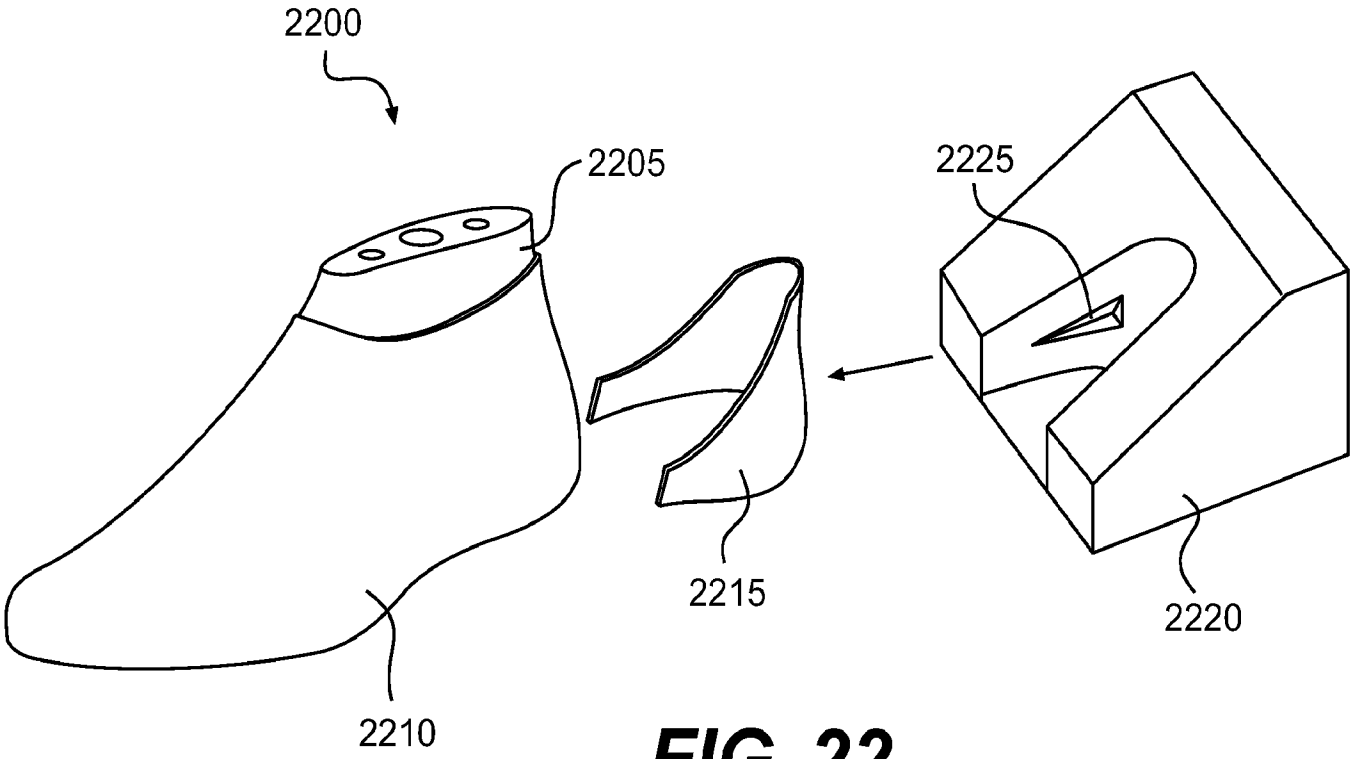
FIG. 22 is a perspective view of an exemplary method molding a heel counter of an article of footwear.

FIG. 22 depicts a method of making an article of footwear including molding a heel counter of the article of footwear into a predetermined shape. FIG. 22 shows an apparatus 2200 for making an article of footwear including a last 2205 shaped to resemble a human foot. Last 2205 may be formed, at least in part, of a susceptor material that is thermally responsive to an electromagnetic field to undergo induction heating. Exemplary suitable susceptor materials and components may be selected according to the description above. As shown in FIG. 22, an upper 2210 may be mounted on last 2205. FIG. 22 also shows a heel counter 2215, configured to be fitted to a heel region of upper 2210. Apparatus 2200 may include a support block 2220, or other suitable device to hold heel counter 2215 against last 2205.

Apparatus 2200 may further include an induction coil (not shown). Once assembled, last 2205, upper 2210, heel counter 2215, and support block 2220 may be exposed to an electromagnetic field produced by the induction coil. In response, the susceptor material in last 2205 may undergo induction heating. At least some of the heat produced in the susceptor material may be transferred conductively to heel counter 2215, causing heel counter 2215 to mold into a predetermined shape.

The inner shape of heel counter 2215 created by the molding process may be determined by the shape of underlying last 2205. The outer shape of heel counter 2215 may be determined by the shape of support block 2220. In addition to a generally heel-shaped contour, support block 2220 may have a mold feature 2225 configured to mold a structural feature into heel counter 2215.

Structural features may be molded into footwear components, such as heel counters, toe caps, panels of uppers, midsole components, sole components, and other footwear components. In some embodiments, such molded structural features may include positive structures, that is, structures that protrude from the surface of the footwear component. In some embodiments, the molded structural features may include negative structures, that is, structures involving recesses, indentations, grooves, and other features where material has been displaced. Structural features may be formed on outward-facing surfaces of footwear components and/or on inward-facing surfaces of footwear components. For purposes of explanation, the molding of structural features in outward-facing surfaces of footwear components will be discussed below. It will be understood, however, that similar procedures may be employed to mold structural features into inward-facing surfaces.

Structural features, such as those discussed above, may provide strength, reinforcement, wear resistance, stiffness, flexibility, reduced weight, foot protection, and other physical attributes to footwear components. In addition, preformed components may be inserted into a mold feature to be joined with the footwear component during the molded process. This may enable a different (for example stronger) material to be used for the structural component. For example, a metal rod may be placed in a semi-cylindrical mold feature in order to mold the metal rod into a rib on a surface of a plastic footwear component. While a plastic rib may provide reinforcement, a plastic rib with an embedded metal rod may provide a higher level of reinforcement.

Figure 23:
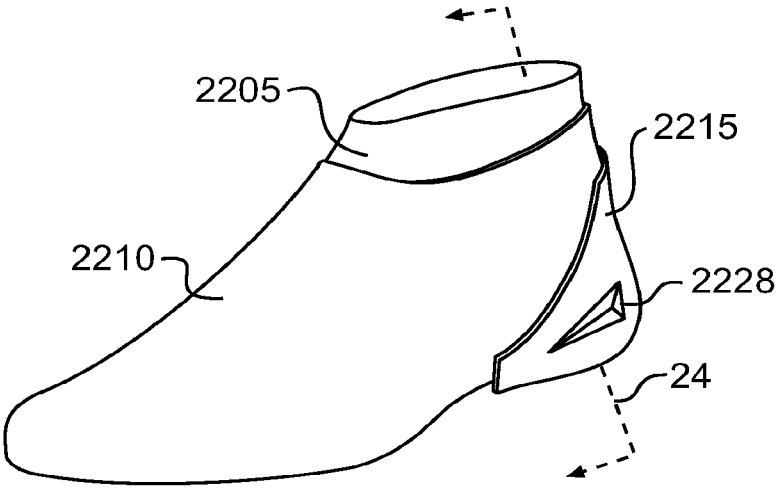
FIG. 23 is a perspective view of an assembly of a heel counter and an upper mounted on a last.
Figure 24:
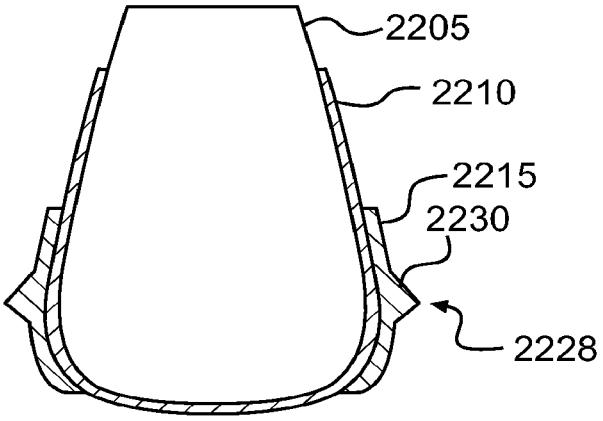
FIG. 24 is a cross-sectional view of an assembly of a heel counter and an upper mounted on a last.

A mold feature, such as mold feature 2225 shown in FIG. 22, may be configured to form a positive or negative structural feature in an outward facing surface of a heel counter. FIG. 23 illustrates a structural feature 2228 in heel counter 2215 that may be formed by mold feature 2225 during the molding process discussed above. FIG. 24 is a cross-sectional view taken at line 24 in FIG. 22. As shown in FIG. 24, in some embodiments, structural feature 2228 may be a positive structure, such as a rib 2230. Rib 2230 may reinforce heel counter 2215 by providing strength and/or stiffness. Rib 2230 may also provide wear resistance, by acting as a bumper, preventing scuffing of heel counter 2215.

Figure 25:
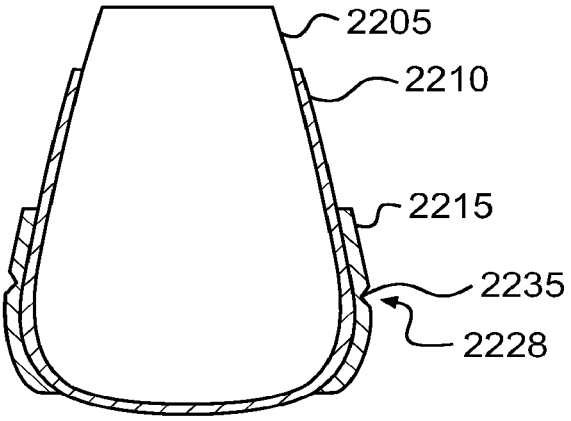
FIG. 25 is a cross-sectional view of an assembly of a heel counter and an upper mounted on a last.

FIG. 25 is a cross-sectional view also taken at line 24 in FIG. 23. As shown in FIG. 25, in some embodiments, structural feature 2228 may be a negative structure, such as a groove 2235. A negative structure, such as groove 2235 may provide reinforcement as well. Alternatively, or additionally, groove 2235 may provide weight reduction by removing material from that portion of heel counter 2215.

Although rib 2230 and groove 2235 are shown as generally horizontal, such structural features may have any suitable orientation and may be placed on footwear at any suitable location. Those having ordinary skill in the art will recognize possible applications for mold-formed ribs, grooves, and other types of structural features.

Figure 26:
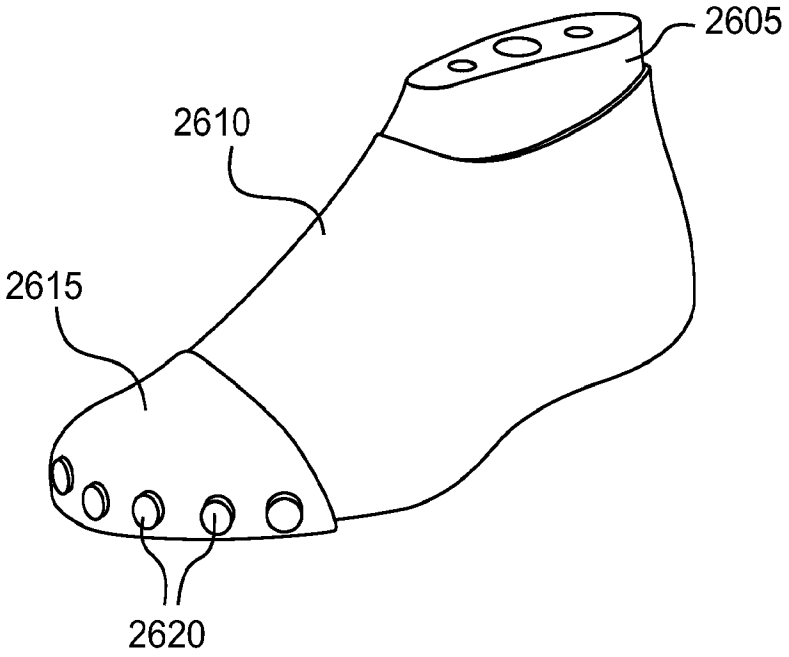
FIG. 26 is a perspective view of an assembly of a toe cap and an upper mounted on a last.

FIG. 26 illustrates another type of structural feature that may be molded into an outward-facing surface of a footwear component. As shown in FIG. 26, a last 2605 may have an upper 2610 mounted on it. FIG. 26 also shows a toe cap 2615. Toe cap 2615 illustrates a plurality of molded-in projections 2620, extending from the outer surface of toe cap 2615. Like other positive structures, projections 2620 may have any suitable shape and may be disposed any suitable location. Also like other positive structures, projections 2620 may provide strength, stiffness, wear resistance, and/or protection for a wearer's feet.

Manufacturing Processes—Susceptor in Footwear

Induction heating may be implemented in various ways using susceptor materials disposed in components of the footwear. An electromagnetic field may inductively heat the susceptor material in the footwear components. This inductive heating may be used to join footwear components together and/or to mold footwear components. The following discussion describes exemplary methods of joining and/or molding footwear components using the induction heating of susceptor materials in the footwear components themselves.

A. Joining

An exemplary method of making an article of footwear may include providing a last shaped to resemble a human foot. The method may include forming at least one footwear component at least in part from a susceptor material that is thermally reactive to an electromagnetic field. In some embodiments, only part of a footwear component may be formed of the susceptor material. For example, in joining methods, peripheral portions of footwear components may be formed of susceptor material. In other embodiments, the entire footwear component may be formed of a susceptor material. In some embodiments, all or a part of the footwear component may be impregnated with susceptor material. In addition, for joining processes, one or both of the footwear components to be joined may include susceptor material.

The method may also include covering at least a portion of the last with the footwear component formed at least in part from the susceptor material and applying an electromagnetic field to the susceptor material, causing induction heating of the susceptor material. In addition, the method may include joining the footwear components together by melding components with the induction heating.

Figure 27:
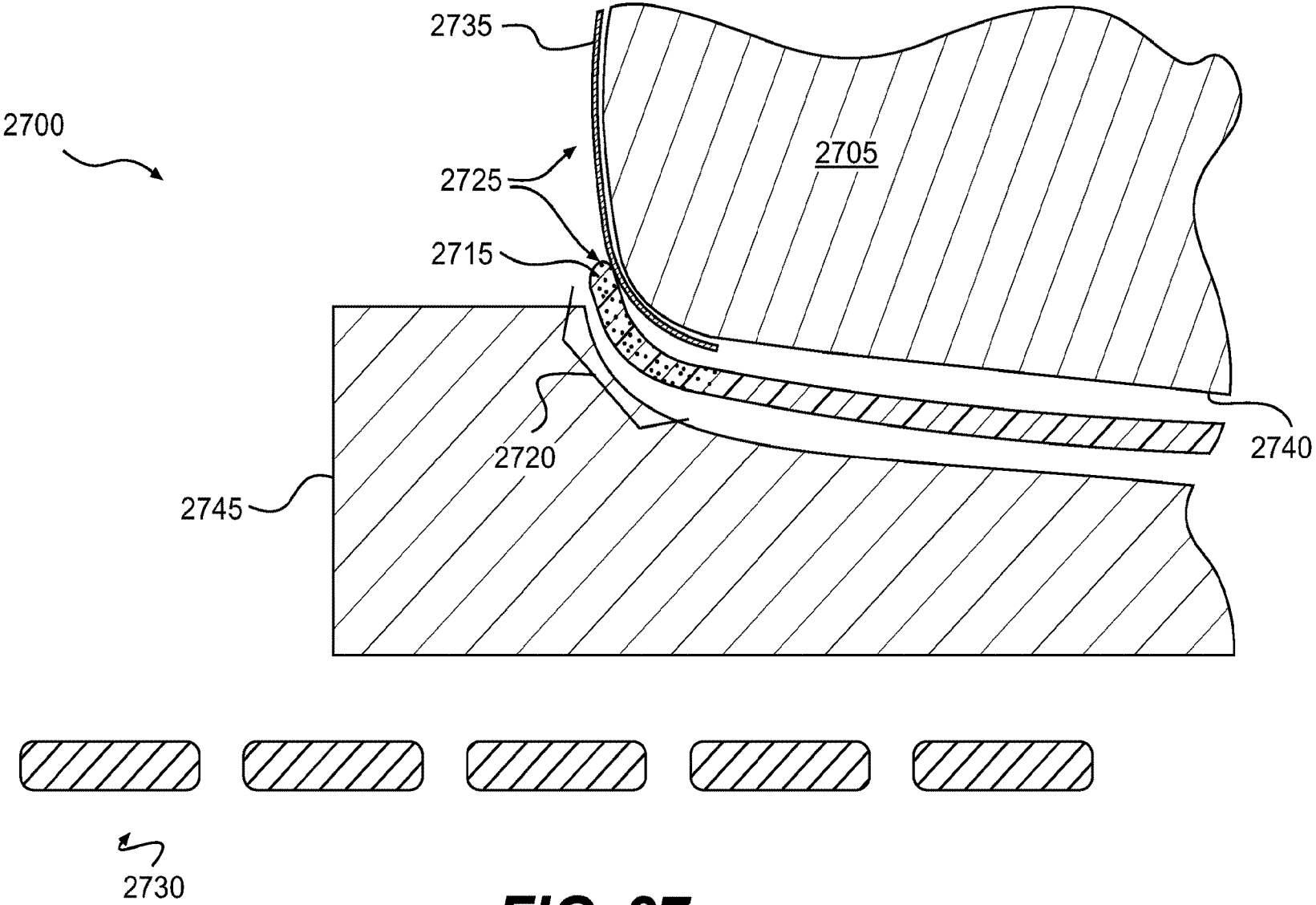
FIG. 27 is a partial cross-sectional view of an apparatus for making an article of footwear assembled for executing a heating process.

FIG. 27 illustrates an exemplary method of making an article of footwear including joining footwear components using induction heating wherein at least one of the footwear components is formed, at least in part, from a susceptor material. An apparatus 2700 for making an article of footwear may include a last 2705 shaped to resemble a human foot.

As shown in FIG. 27, a component of a midsole, such as a support plate 2715, may be formed, at least in part, from a susceptor material that is thermally reactive to an electromagnetic field. As shown in FIG. 27, support plate 2715 may be formed partially of a susceptor material. For example, a section 2720 of support plate 2715 is shown with stippling, indicating the presence of susceptor material.

At least a portion of last 2705 may be covered with two or more footwear components 2725. For example, footwear components 2725 may include support plate 2715 and an upper 2735. In some cases an upper may surround a bottom portion of a last, as shown in conjunction with other embodiments discussed herein. However, in other embodiments, an upper may cover side portions of a last, with a bottom portion of a last substantially uncovered by upper material. FIG. 27 shows such an embodiment, where upper 2735 does not extend fully across a sole portion 2740 of last 2705.

As shown in FIG. 27, support plate 2715 and upper 2735 may be joined at portions where the components overlap one another. For example, as shown in FIG. 27, section 2720 of support plate 2715 may overlap upper 2735, and thus, joinder of these two components may be made in this area.

An induction coil 2730 may be used to apply an electromagnetic field to the susceptor material, thus causing induction heating of the susceptor material. As a result, support plate 2715 may be fixedly attached to upper 2735, for example, by melding the two components together with the induction heating. Joinder of support plate 2715 and upper 2735 may be facilitated by a support block 2745, in a manner similar to that discussed in conjunction with other embodiments above.

In addition to midsole components, such as support plates, and upper panels, other types of footwear components may be joined using induction heating of susceptor materials incorporated into the footwear components. For example, FIG. 28 illustrates an embodiment, wherein a heel counter may be formed, at least in part, from susceptor material, and may be molded using induction heating.

Figure 28:
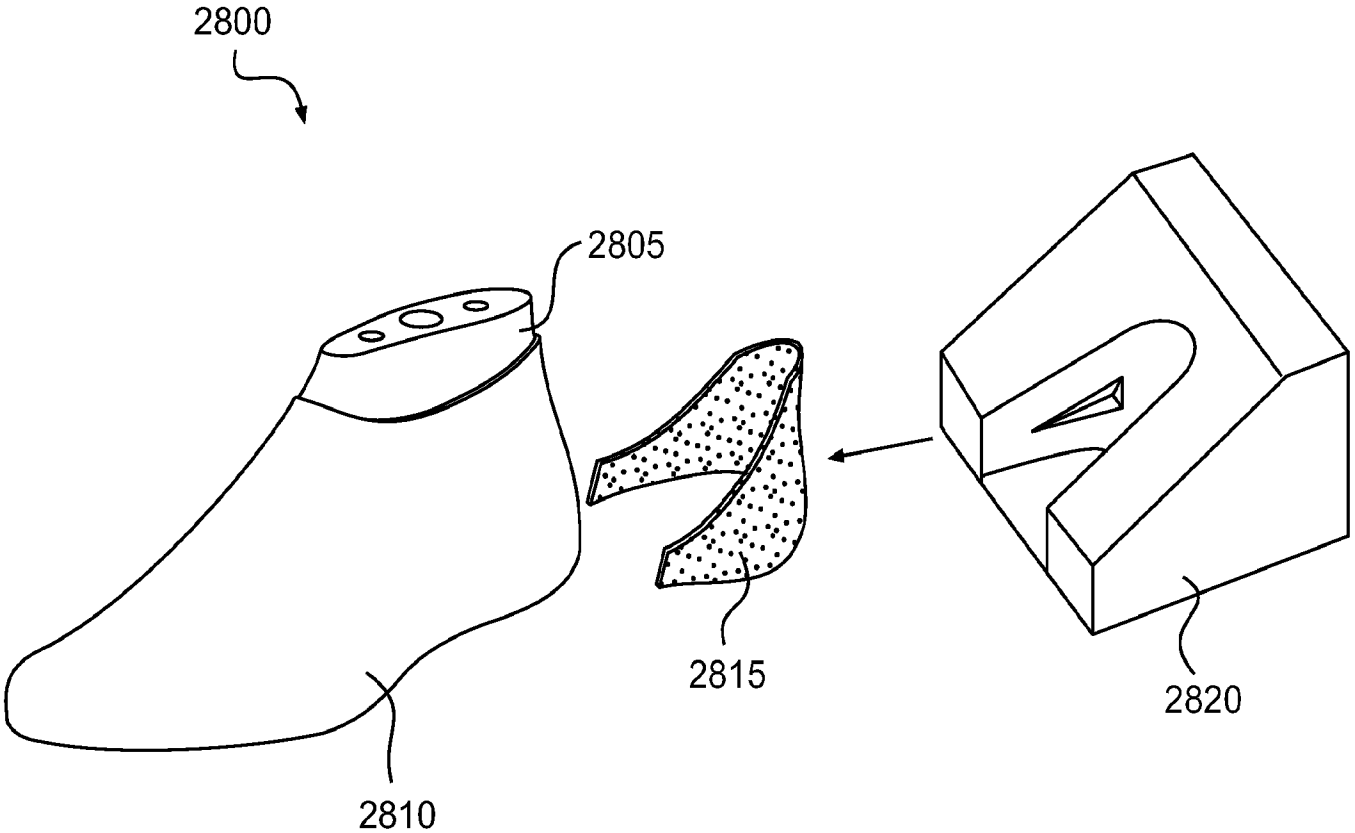
FIG. 28 is a schematic illustration of a process of joining a heel counter to an upper.

As shown in FIG. 28, an apparatus 2800 for making an article of footwear may include a last 2805 shaped to resemble a human foot. An upper 2810 may be fitted onto last 2805. A heel counter 2815 may be formed, at least in part, from a susceptor material. The use of stippling in the depiction of heel counter 2815 is used to indicate the presence of susceptor material. Apparatus 2800 may include a support block 2820 configured to hold and press heel counter 2815 against upper 2810 on last 2805, in a manner discussed in greater detail above in conjunction with other embodiments.

Once last 2805, upper 2810, heel counter 2815 and support block 2820 are assembled, heel counter 2815 may be inductively heated using an induction coil (not shown). The heating may result in the fixed attachment of heel counter 2815 to upper 2810, for example by melding.

Figure 29:
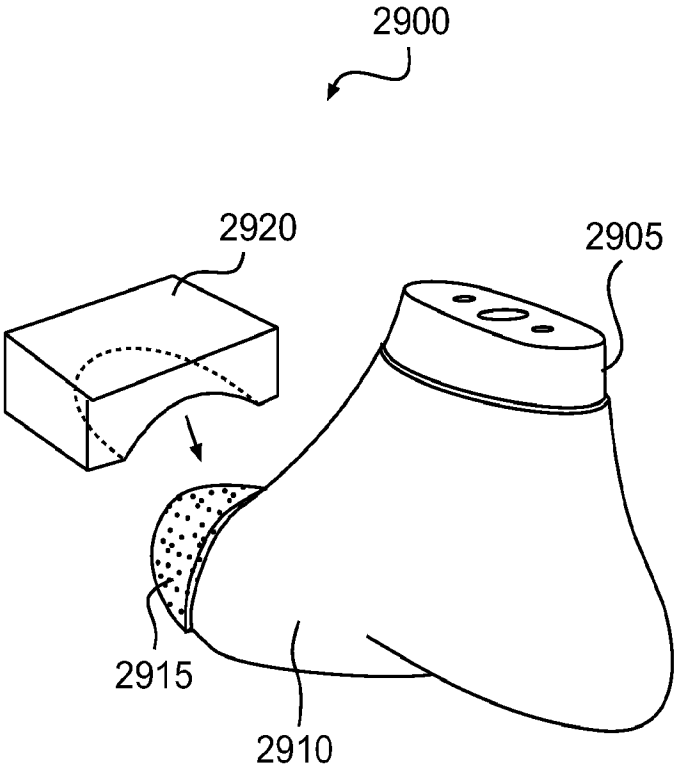
FIG. 29 is a schematic illustration of a process of joining a toe cap to an upper.

FIG. 29 illustrates a similar joining method involving a toe cap. As shown in FIG. 29, an apparatus 2900 for making an article of footwear may include a last 2905 shaped to resemble a human foot. An upper 2910 may be fitted covering last 2905. In addition, a toe cap 2915 may be formed, at least in part, from susceptor material, as indicated by stippling in FIG. 29. A support block 2920 may be used to hold toe cap 2915 against last 2905.

Once last 2905, upper 2910, toe cap 2915 and support block 2920 are assembled, toe cap 2915 may be inductively heated using an induction coil (not shown). The heating may result in the fixed attachment of toe cap 2915 to upper 2910, for example by melding.

Figure 30:
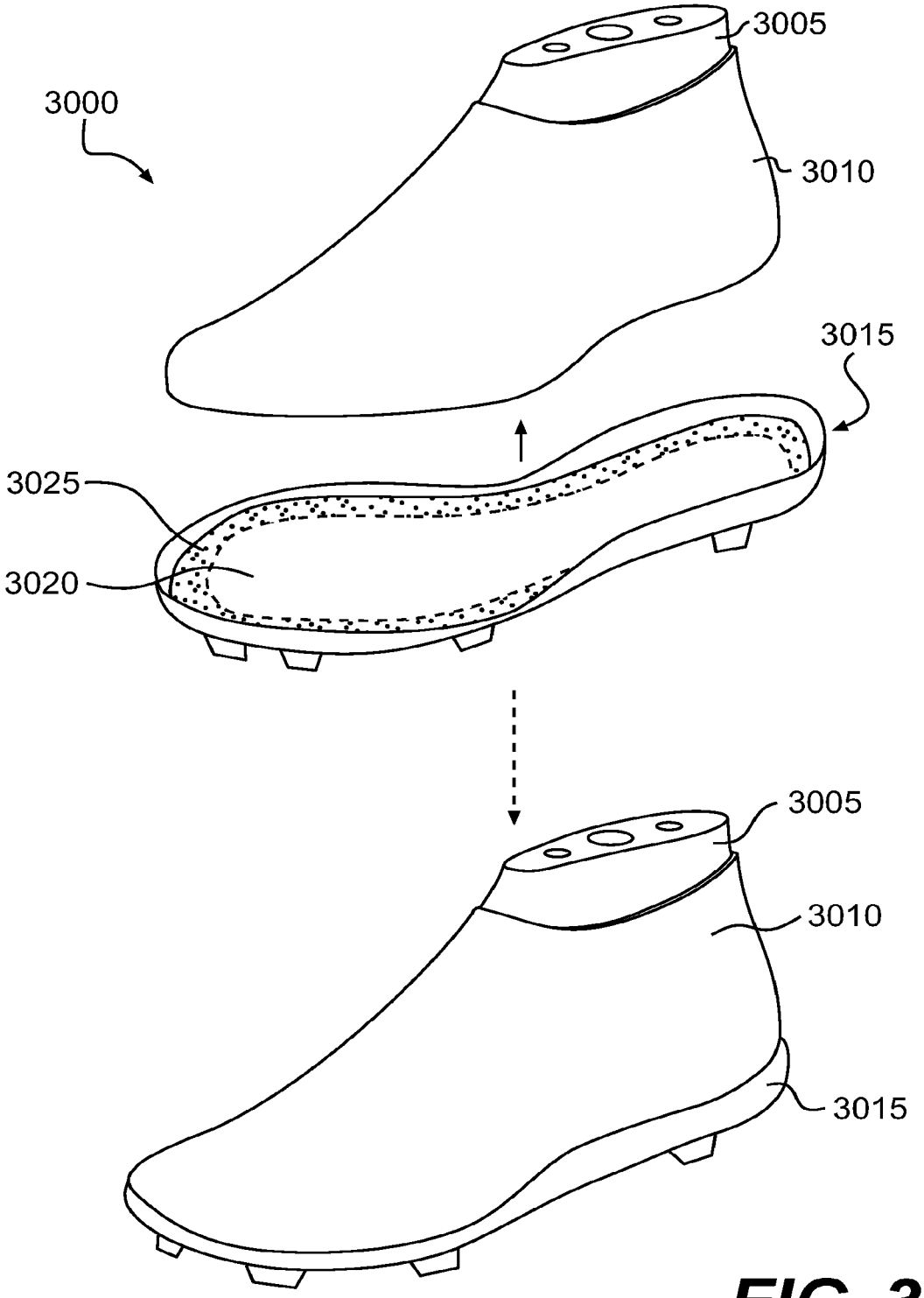
FIG. 30 is a schematic illustration of a process of joining a sole component to an upper.

In addition to midsole components, upper panels, heel counters, toe caps, other footwear components may be joined together using induction heating. For example, FIG. 30 illustrates an exemplary method of joining a ground-contacting sole component to an upper. As shown in FIG. 30, an apparatus 3000 for making an article of footwear may include a last 3005 shaped to resemble a human foot. An upper 3010 may be fitted covering last 3005. A sole component 3015 may formed, at least in part, from susceptor material. In some embodiments, sole component 3015 may include a peripheral region formed of susceptor material. For example, sole component 3015 may include a central portion 3020 and a peripheral portion 3025. In some embodiments, peripheral portion susceptor material may be provided only in peripheral portion 3025, as indicated by stippling in FIG. 30.

Once last 2905, upper 3010, sole component 3015, and a support block (not shown) are assembled, sole component 3015 may be inductively heated using an induction coil (not shown). The heating may result in the fixed attachment of sole component 3015 to upper 3010, for example by melding.

In some cases, the susceptor component may be provided as a film or thin layer of material between components to be joined by inductive heating. For example, in some methods of joining components with inductive heating, a thermoplastic film having an embedded susceptor material may be provided between footwear components to be joined. When the components are held against each other (with the film in between), and subjected to an electromagnetic field, the susceptor-including layer may heat up and melt. In some cases the melted thermoplastic susceptor-including layer may, in turn, melt the surface(s) of either or both of the footwear components to be joined, thereby welding the two components to one another. In some cases, the surfaces of the two components to be joined may remain unmelted, and the melted susceptor-including layer may act as an adhesive, bonding the two footwear components together. A susceptor-including layer, such as a film, may be utilized to join footwear components that also include susceptor material in the components themselves. However, in some cases, neither footwear component to be joined may include susceptor material, and thus, in such cases, the susceptor material may be provided only in the film.

In some embodiments, the induction coil may be part of the last. For example, in some embodiments, a flat type induction coil may be integrated into the surface of the last. A last such as this, having an induction coil, may be used to apply heat to footwear components that include susceptor materials in them. This application of heat may be utilized for joining components and/or for molding components.

Figure 35:
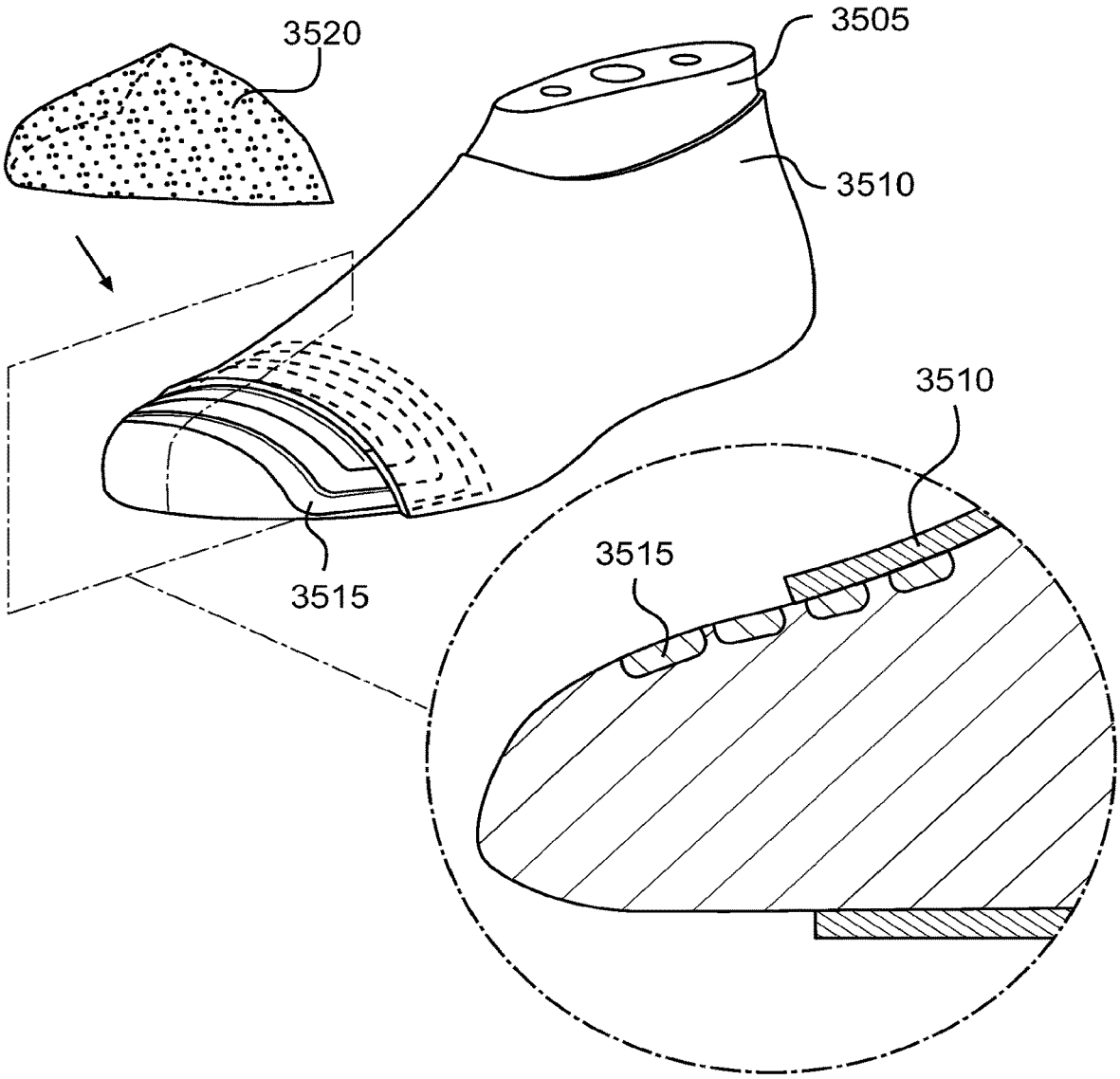
FIG. 35 is a perspective and cross-sectional view of a last including an induction coil.

FIG. 35 shows an exemplary embodiment of a last 3505 with a portion of an upper 3510 mounted on last 3505. In some embodiments, last 3505 may include a flat style induction coil 3515 forming an outer surface of last 3505, as shown in FIG. 35. In some embodiments at least a portion of induction coil 3515 may be embedded within last 3505.

As shown in FIG. 35, a toe cap 3520 formed, at least in part, of a susceptor material (as indicated by stippling) may be molded and/or joined to upper 3510 using last 3505. In some embodiments, as shown in FIG. 35, induction coil 3515 may be disposed at a location on last 3505 that is proximate to the portion of the article of footwear to which heat is desired to be applied. For example, in FIG. 35, induction coil 3515 is disposed across a toe region of last 3505 in order to apply heat to the junction between upper 3510 and toe cap 3520. By locating induction coil 3515 in close proximity to the susceptor material (which, in this case, is in toe cap 3520), efficiency may be increased, because less energy may be used to create a magnetic field to cause the inductive heating of the susceptor material.

B. Molding

An exemplary method of making an article of footwear may include providing a last shaped to resemble a human foot and forming at least one footwear component at least in part from a susceptor material that is thermally reactive to an electromagnetic field. Such a method may include covering at least a portion of the last with the footwear component, and applying an electromagnetic field to the susceptor material, causing induction heating of the susceptor material. The method may further include molding the footwear component into a predetermined shape using the induction heating.

Figure 31:
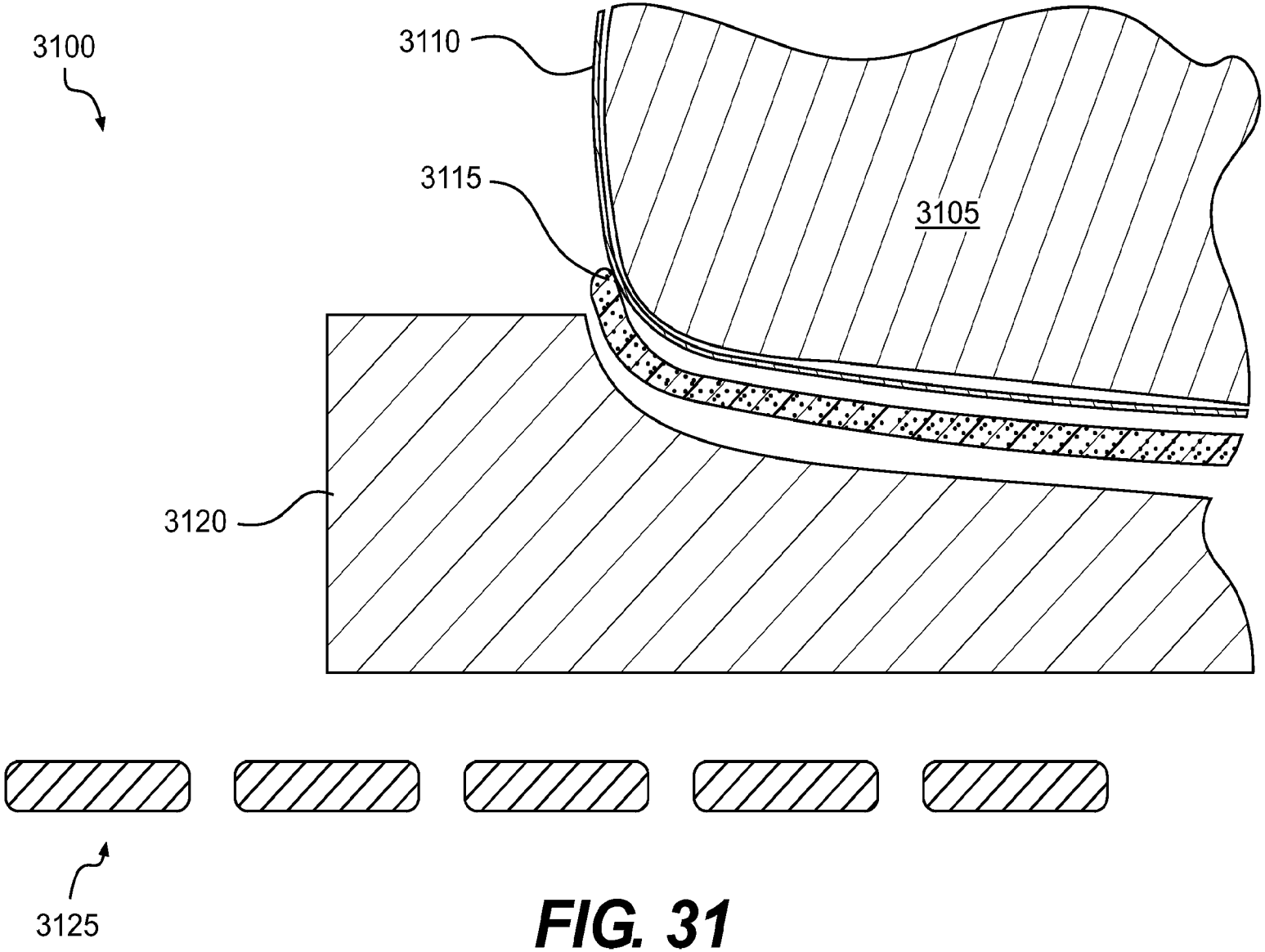
FIG. 31 is a partial cross-sectional view of an apparatus for making an article of footwear assembled for executing a heating process.

FIG. 31 illustrates a method of making an article of footwear, involving induction heating of a footwear component to mold the footwear component. As shown in FIG. 31, an apparatus 3100 for making an article of footwear may include a last 3105 shaped to resemble a human foot. An upper 3110 may be fitted on last 3105. In addition, a midsole component, such as a support plate 3115 may be held in contact with upper 3110 against last 3105. Support plate 3115 may be formed, at least in part, from a susceptor material that is thermally reactive to an electromagnetic field. A support block 3120 may be used to hold support plate 3115 in place in a manner discussed regarding support blocks in other embodiments discussed above.

An electromagnetic field may be applied to the assembly of last 3105, upper 3110, support plate 3115 and support block 3120. An induction coil 3125 may be used to produce the electromagnetic field. Upon exposure to the electromagnetic field to support plate 3115, support plate 3115 may increase in temperature due to induction heating of the susceptor material in support plate 3115. The heating of support plate 3115 may result in molding of support plate 3115 into a predetermined shape.

Figure 32:
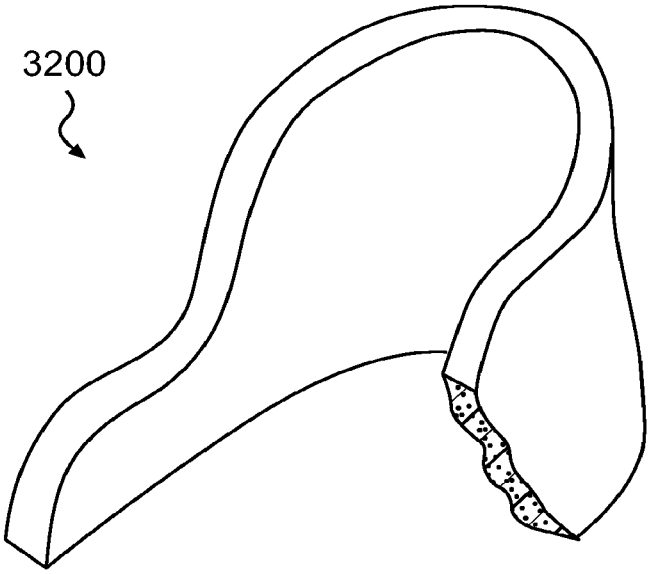
FIG. 32 is a cutaway perspective view of a heel counter.

The molding process discussed above regarding support plate 3115 may be carried out similarly for other footwear components formed of susceptor materials. FIG. 32 is a perspective, cutaway, cross sectional view of a heel counter 3200. As indicated by stippling in FIG. 32, a heel counter 3200 may be formed, at least in part, from a susceptor material. In some embodiments, heel counter 3200 may be formed entirely of a susceptor material. In other embodiments, certain portions of heel counter 3200, such as peripheral edges, may be formed of susceptor material. In some embodiments, one or more portions of heel counter 3200 may be impregnated with susceptor material.

An apparatus and process of molding a heel counter using inductive heating is discussed above. A similar apparatus may be used to inductively heat heel counter 3200 and, thereby mold heel counter 3200 into a predetermined shape using the induction heating. Heel counter 3200 may be molded to have an anatomical shape of the heel portion of a foot. In some embodiments, heel counter 3200 may be molded to include structural features, such as ribs, grooves, or projections, on an outward-facing surface, as discussed above in conjunction with other embodiments.

Figure 33:
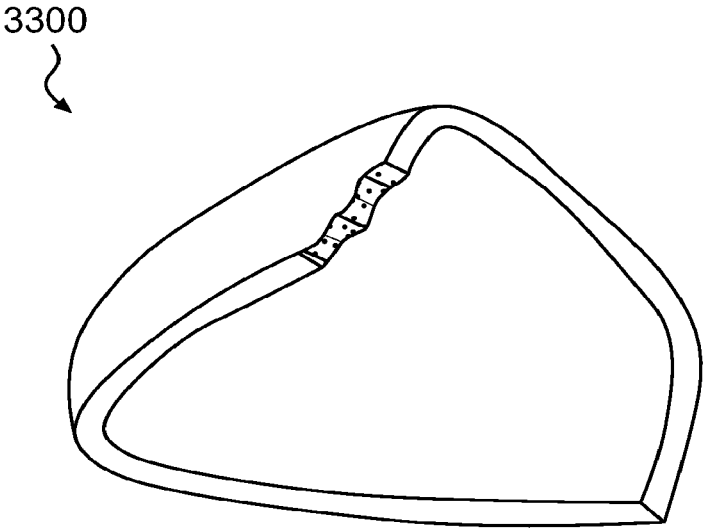
FIG. 33 is cutaway perspective view of a toe cap.

The molding process discussed above regarding support plate 3115 may also be applicable for molding a toe cap formed of susceptor material. FIG. 33 illustrates a toe cap 3300, which may be formed, at least in part, from a susceptor material. In some embodiments, toe cap 3300 may be a panel of an upper of the article of footwear. In other embodiments, toe cap 3300 may be fitted over the upper.

An apparatus and process of molding a heel counter using inductive heating is discussed above. A similar apparatus may be used to inductively heat toe cap 3300 and, thereby mold toe cap 3300 into a predetermined shape using the induction heating. In some embodiments, toe cap 3300 may be molded to include structural features, such as ribs, grooves, or projections, on an outward-facing surface, as discussed above in conjunction with other embodiments.

While various embodiments of the invention have been described, the description is intended to be exemplary, rather than limiting, and it will be apparent to those of ordinary skill in the art that many more embodiments and implementations are possible that are within the scope of the invention. Accordingly, the invention is not to be restricted except in light of the attached claims and their equivalents. Features of any embodiment described in the present disclosure may be included in any other embodiment described in the present disclosure. Also, various modifications and changes may be made within the scope of the attached claims.

The invention claimed is:

1. An apparatus for making an article of footwear, the apparatus comprising:

a last having a first outer surface shaped to resemble an outer surface of a human foot and including a first portion terminating at a first edge and a second portion terminating at a second edge spaced apart from the first edge by a first groove in a heel region of the last; and a first susceptor material that is thermally reactive to an electromagnetic field and is received within the first groove in the heel region of the last, the first susceptor material including a second outer surface extending from a third edge that is flush with and spaced apart from the first edge by a first gap to a fourth edge that is flush with and spaced apart from the second edge by a second gap.

2. The apparatus of claim 1, wherein the first susceptor material is in contact with at least one of the first portion and the second portion.

3. The apparatus of claim 1, wherein the first susceptor material extends across a width of the last from a medial side of the last to a lateral side of the last.

4. The apparatus of claim 1, wherein the first portion is separated from the second portion by the first groove.

5. The apparatus of claim 4, wherein the first portion includes a forefoot region of the last and the second portion includes the heel region of the last.

6. The apparatus of claim 1, further comprising a second susceptor material that is thermally reactive to an electromagnetic field and is received within a second groove of the last, the second groove separating a third portion of the last from one of the first portion and the second portion.

7. An apparatus for making an article of footwear, the apparatus comprising:

a last having a first end surface extending across an entire width of the last from a medial side of the last to a lateral side of the last and a first outer surface shaped to resemble an outer surface of a human foot and extending from a first edge at the first end surface; and a first susceptor material that is thermally reactive to an electromagnetic field and includes a second end surface that extends across the entire width of the last and opposes the first end surface of the last, the first susceptor material including a second outer surface extending from a second edge at the second end surface, the second edge being flush with and spaced apart from the first edge by a first gap extending across the entire width of the last.

8. The apparatus of claim 7, wherein the first susceptor material is spaced apart from the last at the first end surface.

9. The apparatus of claim 7, wherein the first susceptor material extends across the entire width of the last from the medial side to the lateral side.

10. The apparatus of claim 9, wherein the first susceptor material includes a grid pattern.

11. The apparatus of claim 10, wherein the first susceptor material defines a heel region.

12. The apparatus of claim 7, wherein the last includes a first portion and a second portion that are spaced apart from one another by a first groove, one of the first portion and the second portion defining the first end surface.

13. The apparatus of claim 12, wherein the first susceptor material extends across a width of the last from the medial side of the last to the lateral side of the last between the first portion and the second portion.

14. The apparatus of claim 13, wherein the first susceptor material is separated from at least one of the first portion and the second portion.

15. The apparatus of claim 13, wherein the first susceptor material is in contact with at least one of the first portion and the second portion.

16. The apparatus of claim 12, wherein the first portion is separated from the second portion by the first groove.

17. The apparatus of claim 12, wherein the first portion includes a forefoot region of the last and the second portion includes a heel region of the last.

18. The apparatus of claim 12, further comprising a second susceptor material that is thermally reactive to an electromagnetic field and is received within a second groove of the last, the second groove separating a third portion of the last from one of the first portion and the second portion.

19. The apparatus of claim 7, wherein the first susceptor material is located in one of a heel region and a forefoot region of the last.

* * * * *